US010732556B2

(12) United States Patent
Ishida

(10) Patent No.: US 10,732,556 B2
(45) Date of Patent: Aug. 4, 2020

(54) IMAGE FORMING APPARATUS AND MANAGEMENT METHOD FOR IMAGE FORMING APPARATUS

(71) Applicant: Konica Minolta Inc., Tokyo (JP)

(72) Inventor: Hirofumi Ishida, Hachioji (JP)

(73) Assignee: Konica Minolta Inc., Tokyo (JP)

( * ) Notice: Subject to any disclaimer, the term of this patent is extended or adjusted under 35 U.S.C. 154(b) by 0 days.

(21) Appl. No.: 16/453,583

(22) Filed: Jun. 26, 2019

(65) Prior Publication Data

US 2020/0019104 A1 Jan. 16, 2020

(30) Foreign Application Priority Data

Jul. 11, 2018 (JP) ..... 2018-131571

(51) Int. Cl.
*G03G 15/00* (2006.01)

(52) U.S. Cl.
CPC ..... *G03G 15/553* (2013.01)

(58) Field of Classification Search
CPC .. G03G 15/50; G03G 15/161; G03G 15/5058; G03G 15/1605; B65H 2220/01
USPC ..... 399/43
See application file for complete search history.

(56) References Cited

FOREIGN PATENT DOCUMENTS

JP 2013-225073 A 10/2013
JP 2016-038710 A 3/2016

*Primary Examiner* — Walter L Lindsay, Jr.
*Assistant Examiner* — Frederick Wenderoth
(74) *Attorney, Agent, or Firm* — Squire Patton Boggs (US) LLP

(57) ABSTRACT

An image forming apparatus includes a counter that counts number of sheets of paper on which printing is performed; a calculator that calculates a coverage rate of each sheet of the paper; a derivation part that derives a reference line to be a replacement indicator for a consumable part based on replacement history information including: number of printed sheets from start of using the consumable part provided in the image forming apparatus until replacement of the consumable part; and an average coverage rate obtained by averaging coverage rates on the sheets of the paper corresponding to the number of printed sheets, and a communicator that provides a notification of arrival of replacement timing of the consumable part based on the reference line.

7 Claims, 14 Drawing Sheets

IMAGE FORMING APPARATUS AND MANAGEMENT METHOD FOR IMAGE FORMING APPARATUS

The entire disclosure of Japanese patent Application No. 2018-131571, filed on Jul. 11, 2018, is incorporated herein by reference in its entirety.

BACKGROUND

Technological Field

The present disclosure relates to an image forming apparatus and more particularly relates to a technology in which a notification of replacement timing of a consumable part can be provided at timing suitable for a user.

Description of the Related art

The image forming apparatus includes a plurality of consumable parts. For example, a cleaning blade is one of the consumable parts. The cleaning blade removes toner remaining on an image carrier (photoreceptor) after a toner image on the image carrier is transferred to a transfer belt.

As for setting replacement time of such a consumable part, JP 2013-225073 A discloses a technology in which "replacement reason information for a consumable part is input, and preset replacement reference information for the consumable part is corrected in accordance with the input replacement reason information for the consumable part" ([ABSTRACT]). Additionally, JP 2016-38710 A discloses a technology in which "a plurality of image forming apparatuses is classified into a plurality of groups by thresholds set for environmental conditions and/or use conditions, and a limit value of deterioration progress of a consumable part to determine that the consumable part has reached or is about to reach a life end is set for each of the image forming apparatuses classified into the groups" (ABSTRACT).

By the way, replacement time of a consumable part in an image forming apparatus is varied by a judgment standard of an administrator of the image forming apparatus (hereinafter referred to as "user") who judges necessity to replace the consumable part. Therefore, even in a case where a manufacturer of the image forming apparatus presets the replacement time of the consumable part at certain time based on a design specification, there may be a case where the replacement time based on the design specification does not coincide with time when the user judges that it is necessary to replace the consumable part. Thus, since the replacement time of the consumable part is finally decided by subjectivity of the user, even though a notification relating to replacement of the consumable part is provided in accordance with the replacement time based on the design specification, the notification does not coincide with timing when the user thinks necessary to replace the consumable part. Therefore, there is a need for a technology in which a notification of the replacement timing of the consumable part to be replaced by a user who uses an image forming apparatus can be provided at timing suitable for the user.

SUMMARY

The present disclosure is made in view of the above-described problem, and an object in an aspect is to prove a technology in which a notification of replacement timing of a consumable part can be provided at timing suitable for the user.

To achieve the abovementioned object, according to an aspect of the present invention, an image forming apparatus reflecting one aspect of the present invention comprises: a counter that counts number of sheets of paper on which printing is performed; a calculator that calculates a coverage rate of each sheet of the paper; a derivation part that derives a reference line to be a replacement indicator for a consumable part based on replacement history information including: number of printed sheets from start of using the consumable part provided in the image forming apparatus until replacement of the consumable part; and an average coverage rate obtained by averaging coverage rates on the sheets of the paper corresponding to the number of printed sheets; and a communicator that provides a notification of arrival of replacement timing of the consumable part based on the reference line, wherein the derivation part derives a first reference line different from the reference line based on past replacement history information and latest replacement history information in accordance with a fact that number of printed sheets included in the latest replacement history information differs from number of printed sheets included in the reference line and corresponding to an average coverage rate same as an average coverage rate of the number of printed sheets of the latest replacement history information, and the communicator provides a notification of arrival of replacement timing of the consumable part based on the first reference line in a case where the first reference line is derived.

BRIEF DESCRIPTION OF THE DRAWINGS

The foregoing and other objects, features, aspects, and advantages provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments. In the following description, identical parts will be denoted by the same reference signs. Names and functions thereof are also the same. Therefore, detailed descriptions thereof will not be repeated.

First Embodiment

<Configuration of Image Forming Apparatus>

Figure 1:
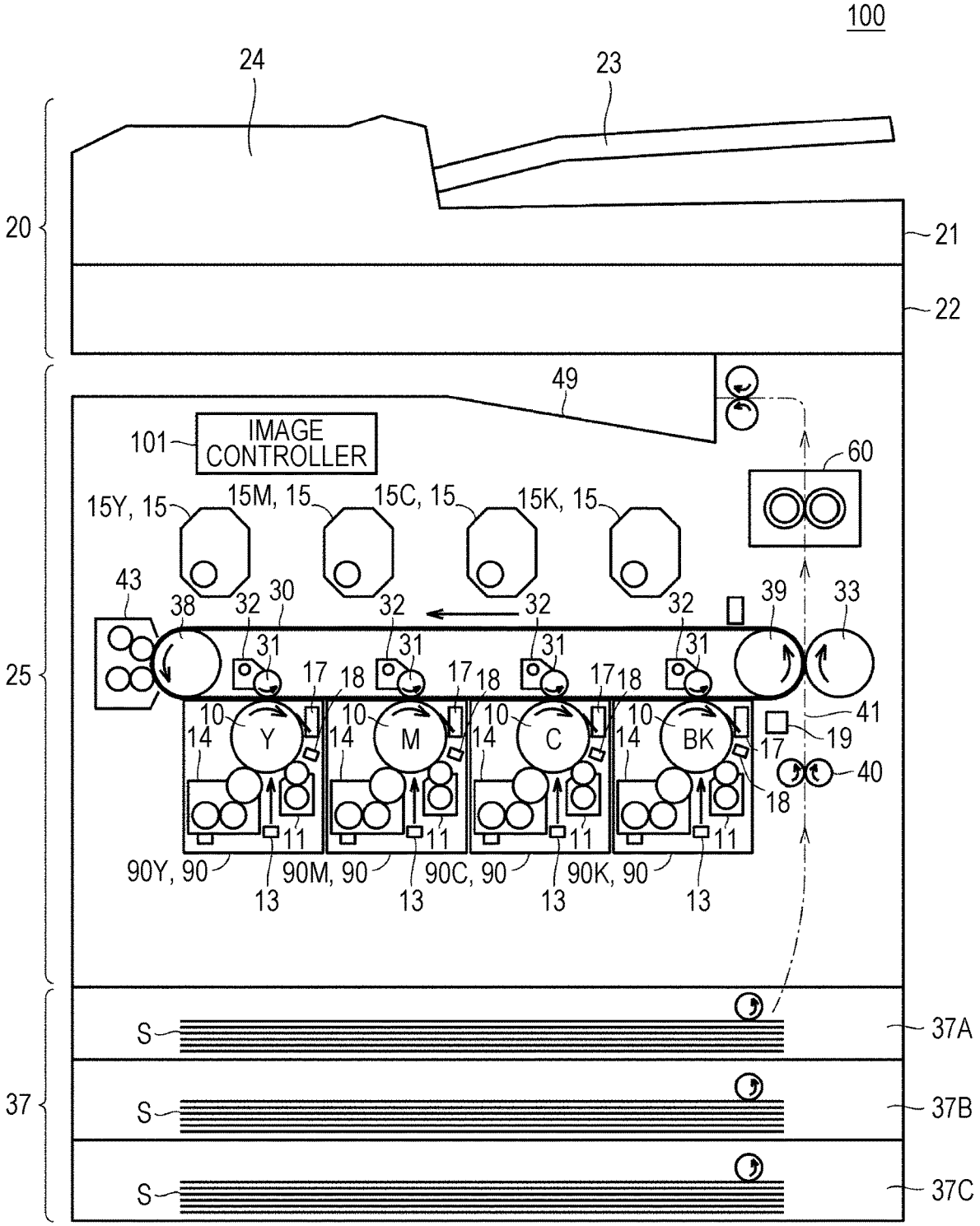
FIG. 1 is a view illustrating an exemplary entire structure of an image forming apparatus according to the present embodiment.

An image forming apparatus 100 according to an embodiment will be described with reference to FIG. 1. FIG. 1 is a view illustrating an exemplary entire structure of the image forming apparatus 100 according to the present embodiment. In the following, a description will be provided assuming that the image forming apparatus 100 is a color printer, but the image forming apparatus 100 is not limited to the color printer. For example, the image forming apparatus 100 may be a monochrome printer, or may be a multi-functional peripheral (MFP) that is a multi-function machine including a monochrome printer or a color printer and a facsimile machine.

The image forming apparatus 100 includes a scanner 20 as an image reader, an image former 25, and a cassette 37. The cassette 37 includes, for example, three cassettes 37A, 37B and 37C. The scanner 20 includes a cover 21, a platen 22, a tray 23, and an auto document feeder (ADF) 24. One end of the cover 21 is fixed to the platen 22, and the cover 21 can be opened/closed while using the one end as a fulcrum.

A user of the image forming apparatus 100 can set a document on the platen 22 by opening the cover 21. When the image forming apparatus 100 receives a scan instruction in a state in which the document is set on the platen 22, the image forming apparatus 100 starts scanning the document set on the platen 22. Additionally, when the image forming apparatus 100 receives a scan instruction in a state in which documents are set on the tray 23, the ADF 24 automatically reads the documents one by one.

The image former 25 includes an image forming unit 90, a toner bottle 15, an image density control (IDC) sensor 19, a transfer belt 30, a primary transfer roller 31, a transfer driver 32, and a secondary transfer roller 33, a driven roller 38, a driving roller 39, a timing roller 40, a cleaning unit 43, a fixing part 60, and an image controller 101.

The image forming unit 90 includes image forming units 90Y, 90M, 90C, and 90K. Additionally, the toner bottle 15 includes toner bottles 15Y, 15M, 15C and 15K. The image forming units 90Y, 90M, 90C, and 90K are arranged sequentially along the transfer belt 30 in a rotation direction of the transfer belt 30. The image forming unit 90Y receives toner supply from the toner bottle 15Y to form a yellow (Y) toner image. The image forming unit 90M receives toner supply from the toner bottle 15M to form a magenta (M) toner image. The image forming unit 90C receives toner supply from the toner bottle 15C to form a cyan (C) toner image. The image forming unit 90K receives toner supply from the toner bottle 15K to form a black (BK) toner image.

Each of the image forming units 90Y, 90M, 90C, and 90K includes a photoreceptor 10 that is rotatable, a charging device 11, an exposure device 13, a developing device 14, a cleaning unit 17, and a toner sensor 18. After the image forming units 90Y, 90M, 90C, and 90K are operated as described above, the yellow (Y) toner image, the magenta (M) toner image, the cyan (C) toner image, and the black (BK) toner image are sequentially superimposed and transferred from the photoreceptor 10 to the transfer belt 30 by transfer performed by the transfer driver 32. Consequently, a color toner image (not illustrated) is formed on the transfer belt 30.

The IDC sensor 19 detects a density (toner amount) of the toner image formed on the transfer belt 30. Typically, the IDC sensor 19 is a light intensity sensor including a reflective photo-sensor, and detects intensity of reflection light from a surface of the transfer belt 30.

The transfer belt 30 is stretched around the driven roller 38 and the driving roller 39. The driving roller 39 is connected to a motor (not illustrated). The motor is controlled by the image controller 101 described later. The driving roller 39 is rotated by controlling the motor. The transfer belt 30 and the driven roller 38 are rotated in conjunction with the driving roller 39. Consequently, the toner image on the transfer belt 30 is fed to the secondary transfer roller 33.

In each of the cassettes 37A to 37C, sheets of paper having different sizes are set. The paper is an exemplary recording medium. The sheets of paper are fed to the secondary transfer roller 33 one by one by the timing roller 40 along a conveyance path 41 from one of the cassettes 37A to 37C. The image controller 101 controls transfer voltage applied to the secondary transfer roller 33 in accordance with timing when the paper is sent out.

The secondary transfer roller 33 applies, to the paper being conveyed, the transfer voltage having a polarity opposite to a polarity of the toner image. Consequently, the toner image is attracted from the transfer belt 30 to the secondary transfer roller 33, and the toner image on the transfer belt 30 is transferred. The conveyance timing of the paper to the secondary transfer roller 33 is controlled by the timing roller 40 in accordance with a position of the toner image on the transfer belt 30. As a result, the toner image on the transfer belt 30 is transferred to an appropriate position on the paper.

The fixing part 60 applies pressure and heat to the paper passing through the fixing part 60. Consequently, the toner image is fixed on the paper. After that, the paper is ejected to a tray 49.

The cleaning unit 43 collects toner remaining on the surface of the transfer belt 30 after transferring the toner image to the paper from the transfer belt 30. The collected toner is conveyed by a conveyance screw (not illustrated) and stored in a waste toner container (not illustrated).

<Hardware Configuration>

Figure 2:
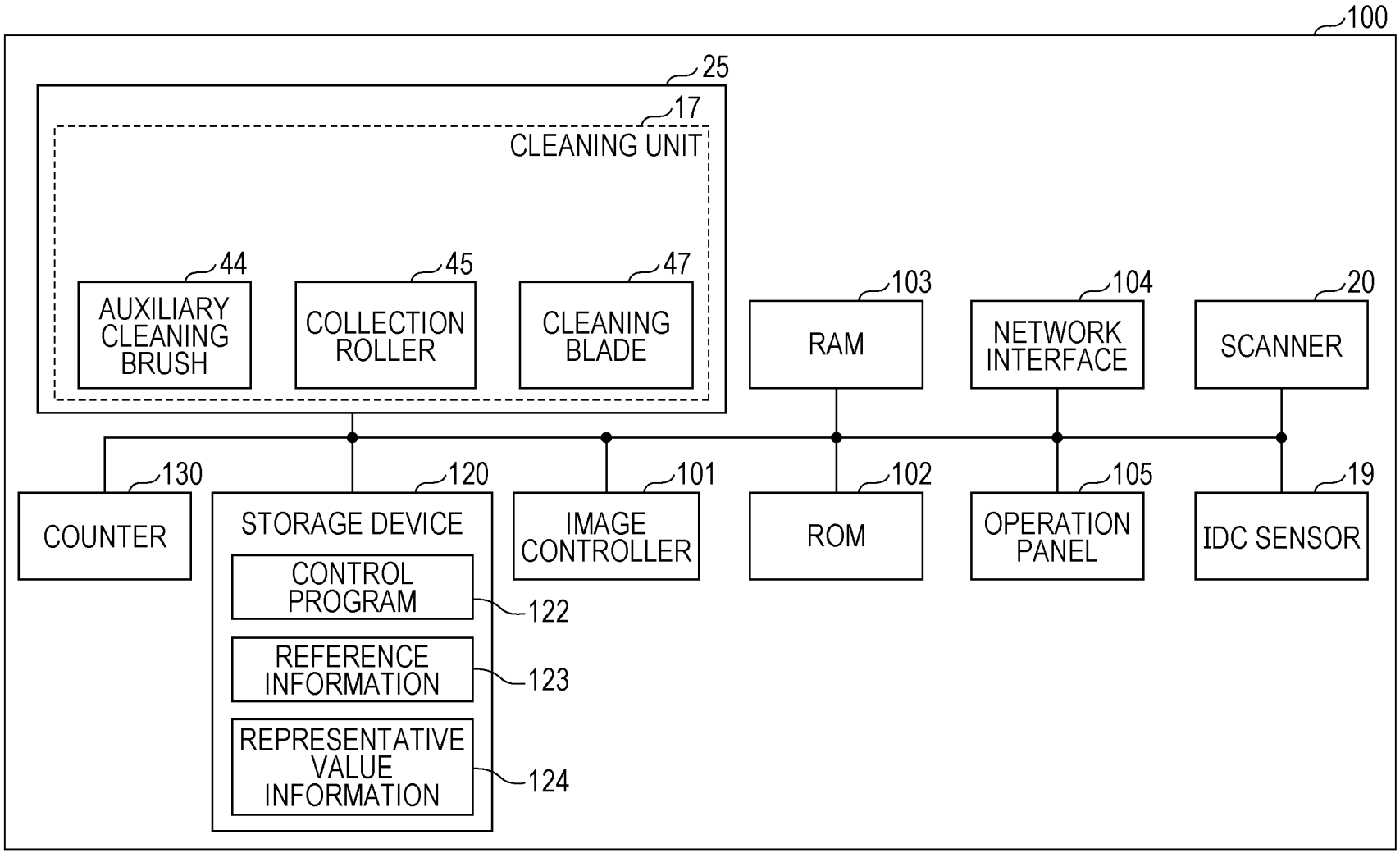
FIG. 2 is a block diagram illustrating a main hardware configuration of the image forming apparatus according to the present embodiment.

FIG. 2 is a block diagram illustrating a main hardware configuration of the image forming apparatus 100 according to the present embodiment. An exemplary hardware configuration of the image forming apparatus 100 will be described with reference to FIG. 2. The image forming apparatus 100 includes not only the IDC sensor 19, the scanner 20, and the image former 25 but also the image controller 101, a read only memory (ROM) 102, a random access memory (RAM) 103, and a network interface 104, an operation panel 105, a storage device 120, and a counter 130. The image controller 101 includes, for example, at least one integrated circuit. The integrated circuit includes, for example, at least one central processing unit (CPU), at least one application specific integrated circuit (ASIC), at least one field programmable gate array (FPGA), or a combination thereof The counter 130 counts the number of times that the image former 25 performs image forming operation. More specifically, the counter 130 counts the number of sheets of the paper in each of which an image is printed (the number of printed sheets). Information of the number of printed sheets counted by the counter 130 is output to the image controller 101. Note that the number of printed sheets counted by the counter 130 is reset once when a consumable part is replaced, and counting is started from the beginning (from the first sheet of the number of printed sheets) when use of a next consumable part is started.

The storage device 120 is, for example, a hard disk, a solid state drive (SSD), or another storage device. The storage device 120 may be either a built-in type or an external type. The storage device 120 stores a control program 122 to control execution of print processing in the image forming apparatus 100. Additionally, the storage device 120 also stores reference line information 123 and representative value information 124. The reference line information 123 and the representative value information 124 are information to be replacement indicators for the consumable part. The reference line information 123 includes information of a reference line. The representative value information 124 includes information of a representative value. These two kinds of information will be described in detail later. The storage device 120 stores information of the number of printed sheets counted by the counter 130 and coverage rate information of a printed sheet of paper. Note that a storage place for the control program 122, the reference line information 123, the representative value information 124, and the like are not limited to the storage device 120, and may also be a storage area (such as a cache) of the image controller 101, the ROM 102, the RAM 103, an external apparatus (such as a server), and the like.

The image controller 101 controls operation of the image forming apparatus 100 by executing various kinds of programs such as the control program 122 in order to adjust control parameters of the image forming apparatus 100. The image controller 101 reads the control program 122 from the storage device 120 to the RAM 103 in response to receipt of an execution command of the control program 122. The RAM 103 functions as a working memory and temporarily stores various kinds of data necessary to execute the control program 122.

Additionally, the image controller 101 calculates a coverage rate per printed page. The coverage rate is a numerical value obtained by expressing, as a percentage, a ratio of toner-applied area occupying an image forming region where an image can be formed (region where an image of one page can be formed) in a case where a toner image is formed on an image carrying surface of the photoreceptor 10. The image controller 101 calculates, per page, the coverage rate of each of the yellow (Y) toner image, the magenta (M) toner image, the cyan (C) toner image, and the black (BK) toner image. More specifically, the image controller 101 counts, per page, the number of pixels to which the toner of each of colors Y, M, C, and BK of print image data is applied, and counts the total number of toner-applied pixels. Then, the image controller 101 calculates, for each color, a ratio (percentage) of the counted total number of toner-applied pixels relative to the total number of pixels corresponding to the image forming region of one page. Note that the total number of pixels is a value preset per paper size. Information of the total number of pixels is stored, for example, in the ROM 102.

Additionally, when the current number of printed sheets approaches the number of printed sheets included in a reference line and corresponding to an average coverage rate same as an average coverage rate of the current number of printed sheets, the image controller 101 provides a notification of arrival of replacement timing of the consumable part from the operation panel 105. The reference line is information to be a replacement indicator for the consumable part. Consequently, the image forming apparatus 100 can provide a notification of the replacement timing of the consumable part at timing suitable for a user. The average coverage rate is obtained by adding and averaging coverage rates of the number of printed sheets. Each of the coverage rates is a ratio of the area of a toner image occupying one sheet of paper. Processing to calculate the average coverage rate is executed by the image controller 101.

Furthermore, the image controller 101 derives a new reference line based on past replacement history information and latest replacement history information in accordance with a fact that the number of printed sheets included in the latest replacement history information differs from the number of printed sheets included in the reference line and corresponding to an average coverage rate same as an average coverage rate of the number of printed sheets of the latest replacement history information. Consequently, the image forming apparatus 100 can provide a notification at timing more suitable for a user than providing a notification of arrival of the replacement timing based on the reference line derived in the past. The replacement history information is information including: number of printed sheets from start of using a consumable part (e.g., cleaning blade 47) provided in the image forming apparatus 100 until replacement thereof; and an average coverage rate obtained by averaging coverage rates of sheets of paper corresponding to the number of printed sheets. Additionally, derivation of the new reference line will be described in detail later.

An antenna (not illustrated) or the like is connected to the network interface 104. The image forming apparatus 100 exchanges data with an external communication device via the antenna. The external communication device includes, for example, a mobile communication terminal such as a smartphone or a server. The image forming apparatus 100 may also be able to download the control program 122 from the server via the antenna.

The operation panel 105 includes a display and a touch panel. The display and the touch panel are mutually superimposed and receive operation for the image forming apparatus 100 by touch operation. For example, the operation panel 105 receives operation to execute adjustment processing for the control parameters, and the like. Furthermore, the operation panel 105 displays information indicating that the replacement timing of the consumable part is approaching (hereinafter, also referred to as replacement information).

The replacement information is information of which the user is notified by using at least any one of characters and/or figures indicating necessity to replace the consumable part. The notification of the replacement information to the user may also be sound information output from a speaker (not illustrated) provided in the image forming apparatus 100, besides the information such as the characters displayed on the operation panel 105.

The image former 25 is provided with the cleaning unit 17. The cleaning unit 17 includes an auxiliary cleaning brush 44, a collection roller 45, and the cleaning blade 47.

<Structure of Cleaning Unit>

Figure 3:
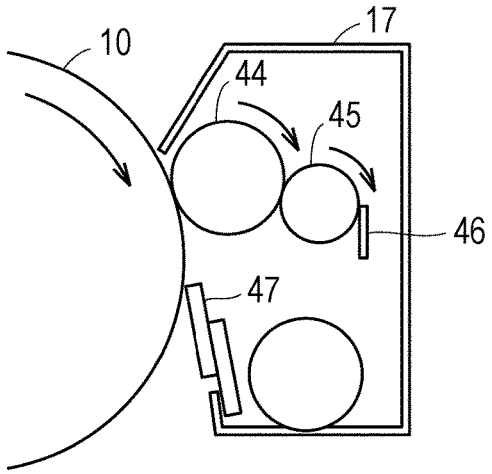
FIG. 3 is a schematic view illustrating respective components included in a cleaning unit according to the present embodiment.

A structure of the cleaning unit 17 will be described with reference to FIG. 3. FIG. 3 is a schematic view illustrating respective components included in the cleaning unit 17 according to the present embodiment. The cleaning unit 17 includes the auxiliary cleaning brush 44, the collection roller 45, a scraper 46, and the cleaning blade 47.

The auxiliary cleaning brush 44 contacts the photoreceptor 10 and removes toner from the photoreceptor 10 by electrostatic attraction with bias voltage. For the auxiliary cleaning brush 44, a rotatable roller type brush is used. The roller type brush has a brush including elastic conductive fibers around a rotatable core metal. The auxiliary cleaning brush 44 is rotationally driven by a driver not illustrated.

In the present embodiment, a driving direction of the auxiliary cleaning brush 44 may be a counter direction of a rotation direction of the photoreceptor 10 or may be a width direction. For the conductive fibers, fibers in which conductive agents such as carbon black are dispersed can be used. As the fibers, nylon, acrylic, rayon, polyester or the like can be used. Fineness may be 1 to 10 deniers, more preferably, 2 to 6 deniers.

The collection roller 45 has a rotatable roller that abuts on the auxiliary cleaning brush 44. Residual toner and the like can be removed from a surface of the collection roller 45 by making a tip of the plate-shaped scraper 46 abut on the roller surface.

In the cleaning blade 47, a flat rubber blade is fixed to a holding member such as a sheet metal. The holding member may be fixed to a housing of the cleaning unit 17 or may have a structure that makes the spring apply a load so that the cleaning blade 47 abuts on the photoreceptor 10 by a constant load. As a property of the cleaning blade 47, impact resilience may be 10 to 80%, more preferably, 30 to 70%. The JIS-A hardness may be 20 to 90 degrees, more preferably, 60 to 80 degrees. In a case of low hardness, noise of the cleaning blade 47 and curl-up of the blade occurs because an abutment posture of the rubber blade is not stabilized. In a case of high hardness, cleaning failure tends to occur because the rubber blade hardly follows a shape of the photoreceptor 10. Therefore, the cleaning blade 47 having appropriate hardness is used. As an abutment condition of the cleaning blade 47, an abutment load may be 1 to 40 [N/m], more preferably, 5 to 25 [N/m].

The abutment load can be measured by making an edge of the cleaning blade 47 abut on a load cell arranged at an abutment position between the photoreceptor 10 and the cleaning blade 47. In a case where the abutment load is too small, cleaning failure occurs due to insufficient frictional force between the cleaning blade and the photoreceptor 10. In contrast, in a case where the abutment load is too large, durability of the image forming apparatus 100 is decreased by image noise caused by wear of the photoreceptor 10 due to the large frictional force. Therefore, the abutment load applied to the cleaning blade 47 is adjusted to be appropriate.

The cleaning blade 47 is a consumable part, and the rubber blade is worn out by being used for a certain period. Therefore, a service person or the like of a manufacturer of the image forming apparatus 100 needs to replace the consumable part periodically. Additionally, besides the cleaning blade 47, the image forming apparatus 100 includes, in the image former 25, various kinds of consumable parts such as the photoreceptor 10, the primary transfer roller 31, and the secondary transfer roller 33. The manufacturer of the image forming apparatus 100 predetermines replacement time for each of these consumable parts in accordance with the design specification, however; there may be a case where each replacement time based on the design specification does not coincide with time when a user determines necessary to replace each consumable part.

Since the replacement time of each consumable part is finally decided by subjectivity of the user, even though a notification relating to replacement of the consumable part is output to the user in accordance with the replacement time based on the design specification, the notification does not coincide with the timing when the user thinks necessary to replace the consumable part of the image forming apparatus. Therefore, a technology that can provide a notification of timing when the user thinks necessary to replace each consumable part of the imaging forming apparatus is required. In the following, derivation processing of a reference line serving as a replacement indicator for a consumable part will be described by exemplifying the cleaning blade 47 that is one of the consumable parts.

<Derivation of Reference Line>

The image controller 101 derives a reference line to be a replacement indicator for the cleaning blade 47 based on: the number of printed sheets from start of using the consumable part (e.g., the cleaning blade 47) until replacement thereof; and an average coverage rate obtained by averaging coverage rates of sheets of paper corresponding to the number of printed sheets. The image controller 101 stores, as the reference line information 123, the derived reference line information in the storage device 120.

Figure 4:
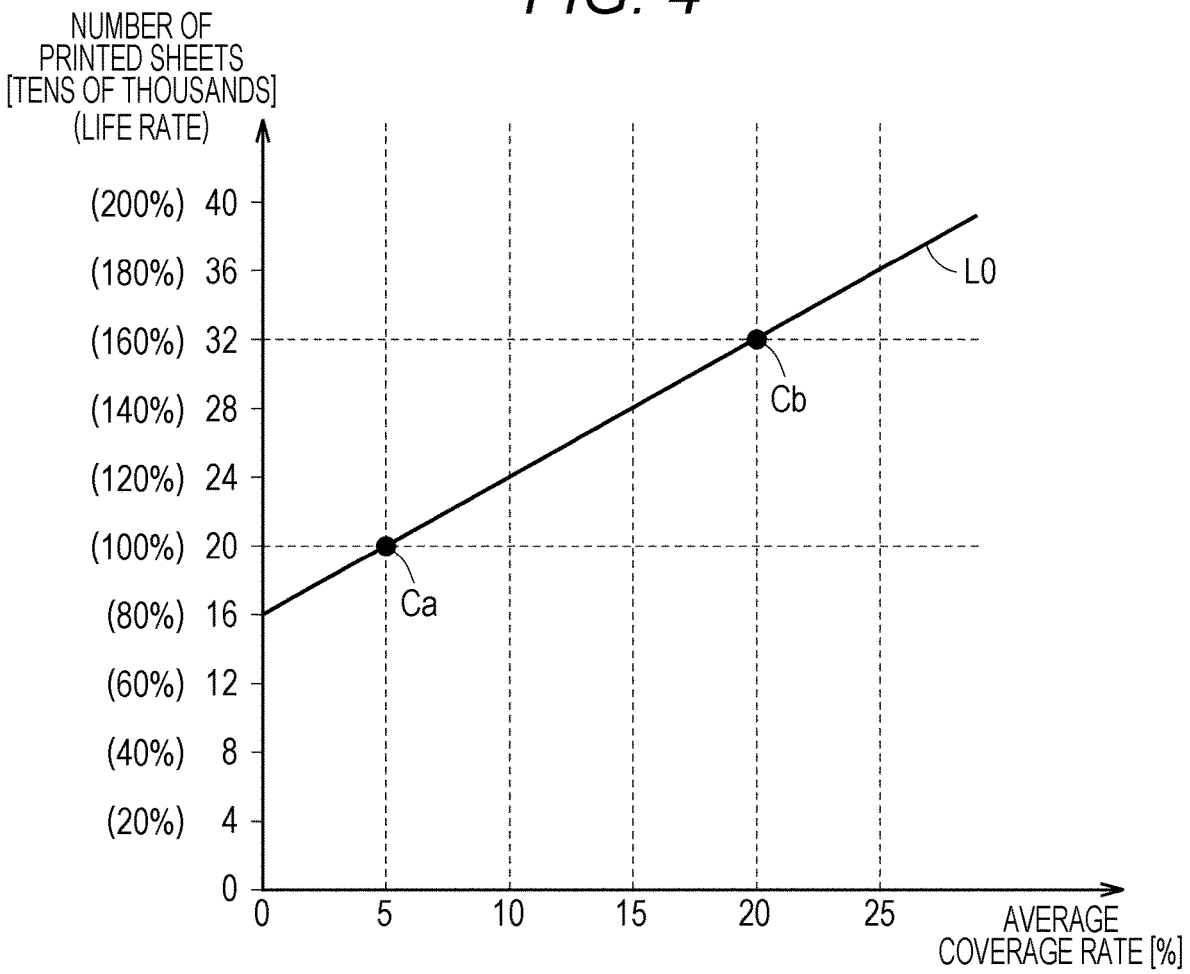
FIG. 4 is a graph illustrating a standard line according to the present embodiment.

Derivation of the reference line to be the replacement indicator for the consumable part will be specifically described with reference to FIGS. 4 to 9. FIG. 4 is a graph illustrating a standard line L0 according to the present embodiment. The standard line L0 is a standard reference line based on the design specification that has been initially set by the manufacturer before actually running the image forming apparatus 100. A vertical axis of the graph in FIG. 4 represents the number of printed sheets [tens of thousands of sheets], and a horizontal axis represents average coverage rate [%]. The number of printed sheets of the vertical axis corresponds to a life rate of the consumable part. The life rate is an indicator to indicate arrival of replacement time of the consumable part of the image forming apparatus 100 when printing for the number of sheets corresponding to 100% is executed. In a case where an average coverage rate is 5%, the number of printed sheets corresponding to the life rate 100% illustrated in FIG. 4 is the number of printed sheets (e.g., 200,000 sheets) determined by the design specification and counted from start of using the cleaning blade 47 until replacement thereof.

Next, a correspondence relation between the number of printed sheets (life rate) and an average coverage rate will be described. In a case where the standard line L0 of FIG. 4 is used as the replacement indicator for the cleaning blade, the life rate of the cleaning blade 47 is 100% when the number of printed sheets having the average coverage rate 5% reaches 200,000 sheets as indicated at a point Ca. Based on the standard line L0, the image controller 101 outputs replacement information from the operation panel 105, assuming that the replacement timing of the cleaning blade 47 arrives at a time point before the number of printed sheets reaches 200,000 sheets. For example, the time point before the number of printed sheets reaches 200,000 sheets is, for example, when the image controller 101 acquires, from the counter 130, count information of the number of printed sheets of 199,000 sheets (one thousand sheets before 200,000 sheets). The relation between the average coverage rate and the number of printed sheets in such a standard line L0 is preset by the design specification. More specifically, the standard line L0 is set such that the larger the average coverage rate is, the larger the number of printed sheets is. The reason is that the larger the average coverage rate is, the more slippery an edge part (rubber) of the cleaning blade 47 becomes. Thus, when a toner amount on paper is large, friction between the edge part of the cleaning blade 47 and the photoreceptor 10 is reduced. Due to this, in a case where the average coverage rate is large, a period until replacement of the cleaning blade 47 becomes longer than in a case where the average coverage rate is small.

Additionally, as illustrated at another point Cb of the standard line L0, when the number of printed sheets having the average coverage rate 20% reaches 320,000 sheets, the life rate of the cleaning blade 47 becomes 160%. In other words, the period until the replacement of the cleaning blade becomes longer than in the case of the average coverage rate 5%. The image controller 101 instructs the operation panel 105 to output the replacement information before reaching the number of printed sheets of 320,000 sheets (for example, when 319,000 sheets are counted). The operation panel 105 notifies a user of the replacement information based on the instruction from the image controller 101. Thus, when the average coverage rate is 20% (the life rate is 160%), the period until replacement of the consumable part becomes longer than when the average coverage rate is 5% (the life rate 100%).

Figure 5:
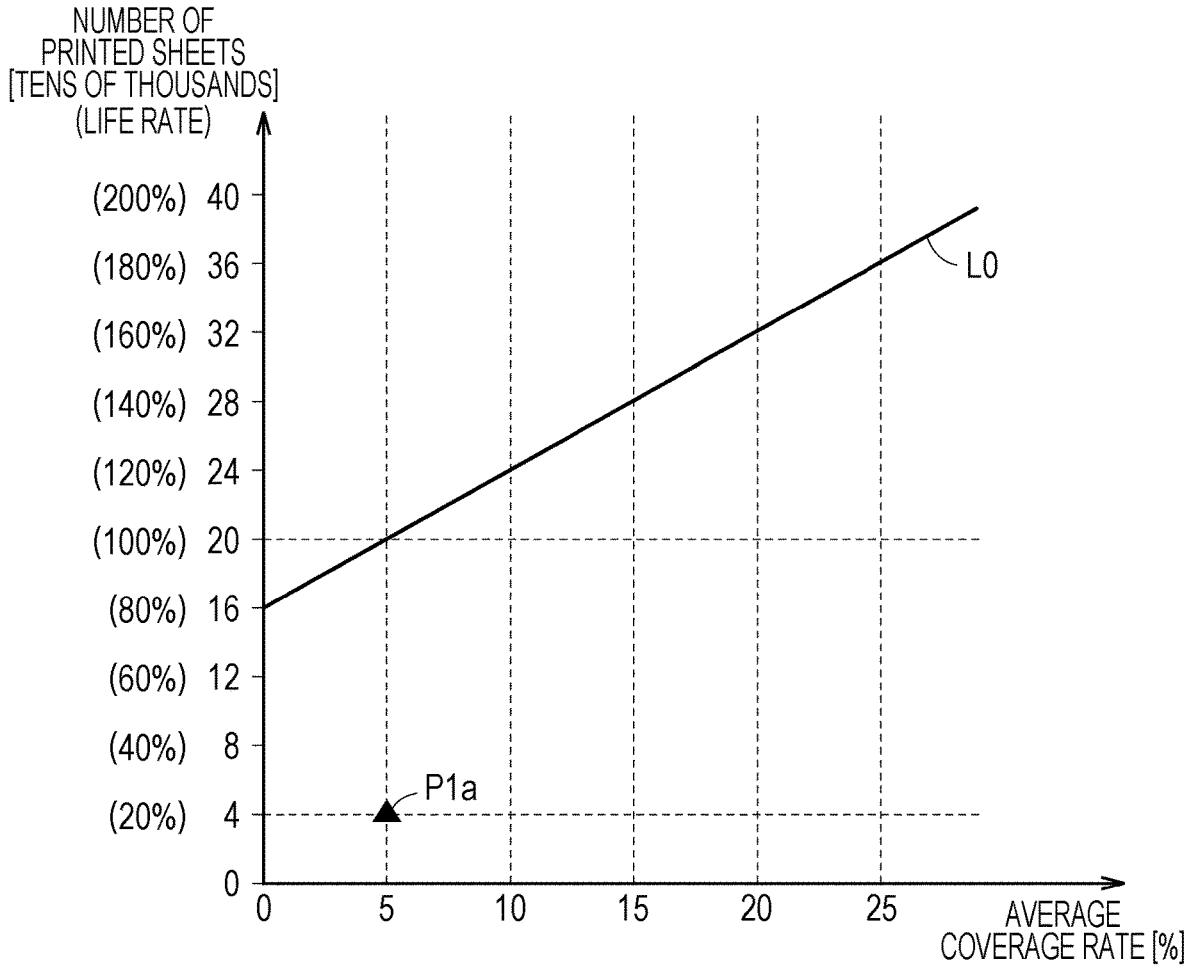
FIG. 5 is a graph illustrating a first printing progress state before replacement of a cleaning blade according to the present embodiment.

FIG. 5 is a graph illustrating a first printing progress state before replacement of the cleaning blade 47 according to the present embodiment. The image controller 101 controls the image forming apparatus 100 including the image former 25. As a result, as indicated at a point Plain FIG. 5, the number of printed sheets having the average coverage rate 5% reaches 40,000 sheets. The life rate of the cleaning blade 47 at this point is 20% with respect to the life rate of 100% at which replacement is required. Stated differently, printing for 80% (160,000 sheets) can be still performed in terms of the design specification.

Figure 6:
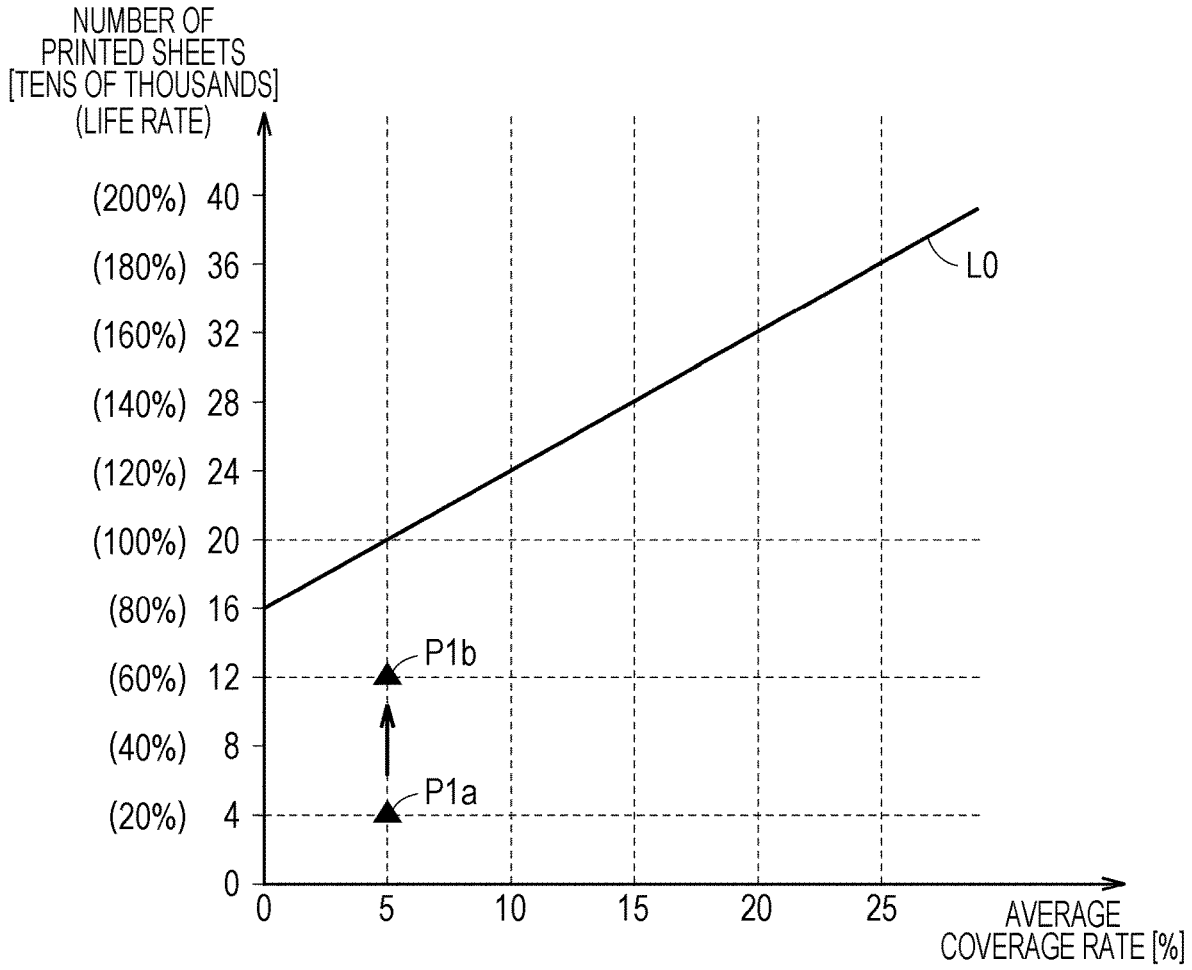
FIG. 6 is a graph illustrating a second printing progress state before replacement of the cleaning blade according to the present embodiment.

FIG. 6 is a graph illustrating a second printing progress state before replacement of the cleaning blade 47 according to the present embodiment. The image controller 101 controls the image forming apparatus 100 including the image former 25. As a result, as indicated at a point P1*b* in FIG. 6, the number of printed sheets having the average coverage rate of 5% reaches 120,000 sheets. The life rate of the cleaning blade 47 at this point is 60% with respect to the life rate of 100% at which replacement is required. Stated differently, printing for 40% (80,000 sheets) can be still performed in terms of the design specification.

Figure 7:
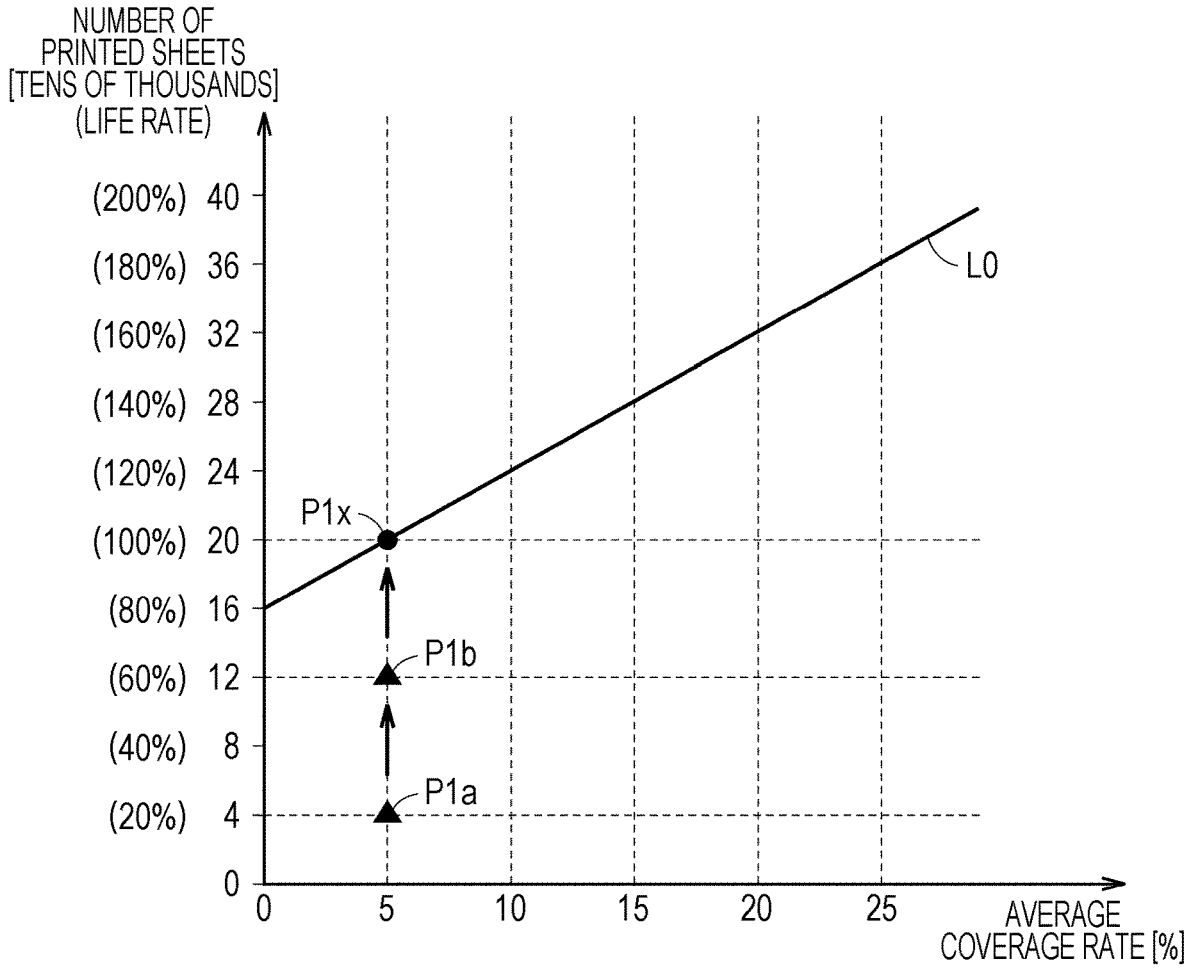
FIG. 7 is a graph illustrating a third printing progress state before replacement of a cleaning blade according to the present embodiment.

FIG. 7 is a graph illustrating a third printing progress state before replacement of the cleaning blade 47 according to the present embodiment. As indicated at a point P1*x* in FIG. 7, the number of printed sheets having the average coverage rate 5% reaches 200,000 sheets. The life rate of the cleaning blade 47 at this point is the 100% life rate at which replacement is required. The image controller 101 instructs the operation panel 105 to output the replacement information before reaching the number of printed sheets of 200,000 sheets (for example, when 199,000 sheets are counted). The operation panel 105 notifies a user of the replacement information based on the instruction from the image controller 101. The user of the image forming apparatus 100 having received the notification of the replacement information contacts a service person, who provides maintenance for the image forming apparatus 100, to inform that the replacement information is output. The service person having received such information from the user replaces the consumable part (e.g., cleaning blade 47) that is a replacement object.

In a case where the cleaning blade 47 is replaced at the time of reaching the number of printed sheets at an average coverage rate same as the number of printed sheets of the reference line L0 at the same average coverage rate, the image controller 101 stores, in the storage device 120, information including the average coverage rate and the number of printed sheets at the time of replacement. The information thus stored in the storage device 120 is read as replacement history information at the time of deriving a replacement indicator such as a reference line. Note that in a case where the consumable part is replaced when the number of printed sheets at the time of latest replacement is same as the number of printed sheets of the standard line L0 as described above, the standard line L0 will be continuously used as the replacement indicator at the time of next replacement of the consumable part. On the other hand, in a case where the consumable part is replaced when the number of printed sheets at the time of latest replacement is different from the number of printed sheets of the standard line L0, a new replacement indicator is derived. Next, derivation of a new replacement indicator will be described.

Figure 8:
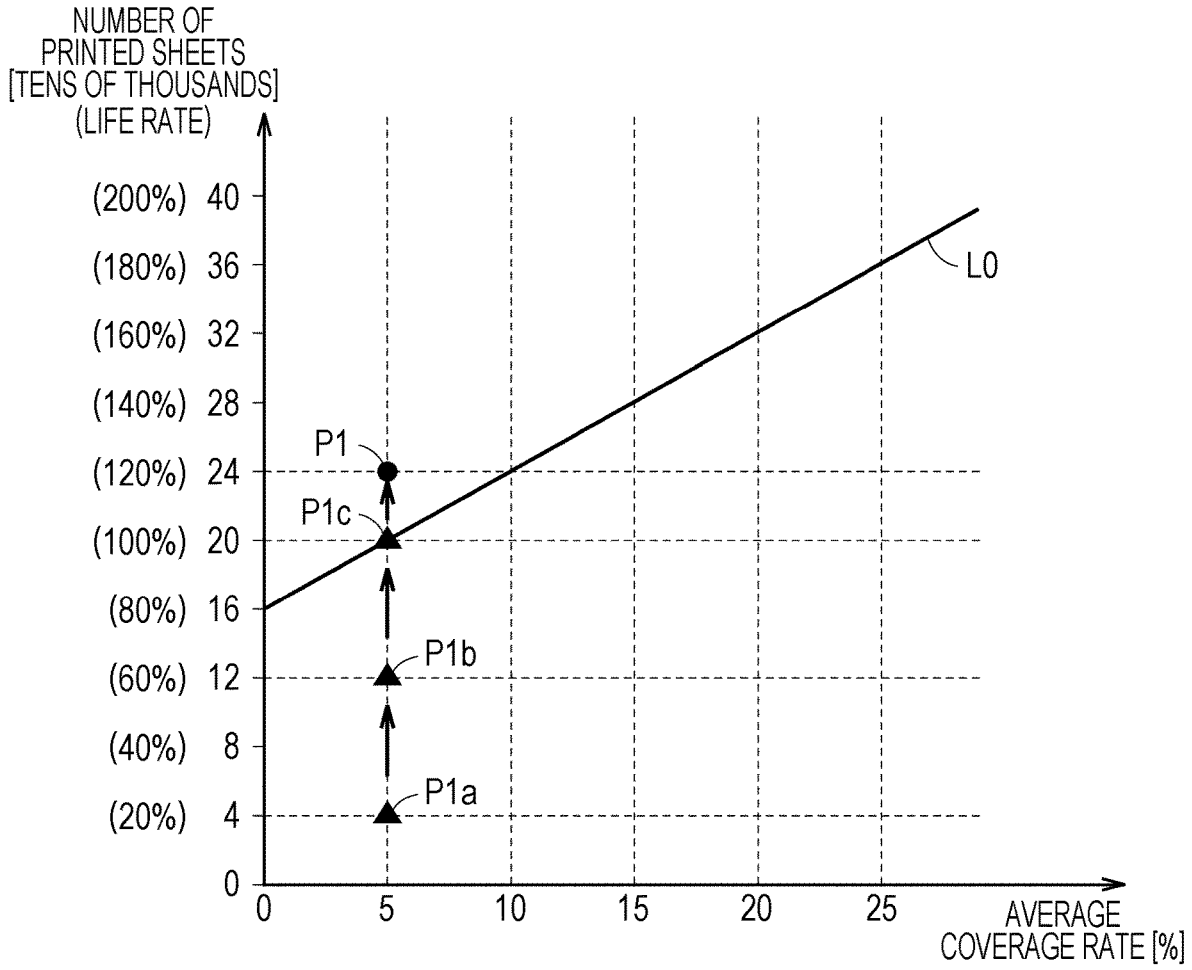
FIG. 8 is a graph illustrating a fourth printing progress state before replacement of a cleaning blade according to the present embodiment.

FIG. 8 is a graph illustrating a fourth printing progress state before replacement of the cleaning blade 47 according to the present embodiment. As indicated at point P1 in FIG. 8, the number of printed sheets having the average coverage rate 5% reaches 240,000 sheets. The life rate of the cleaning blade 47 at this point is 120% which exceeds the 100% at which replacement is required, and is in a state of exceeding the number of printed sheets for replacement in terms of the design specification. In the following, the reason and processing content in a case where the cleaning blade 47 is replaced at the time of reaching the number of printed sheets at the point P1 will be described.

The image controller 101 instructs the operation panel 105 to output replacement information before the number of printed sheets reaches 200,000 sheets (for example, when 199,000 sheets are counted). The operation panel 105 notifies the user of the replacement information based on the instruction from the image controller 101. However, it can be considered that the user does not contact the service person for the replacement information because the timing at which the notification of the replacement information is provided is not suitable for replacement timing intended by the user. More specifically, it can be considered that the user judges that printing can be still performed without replacing the consumable part from a fact that there is no failure discovered in a printed state in subjectivity of the user when the user who has been notified of the replacement information checks the printed state on the printed sheet of paper, and the user does not contact the service person to inform that the replacement information is output. Then, in a case where the user continues using the image forming apparatus 100 and the cleaning blade 47 is replaced at the time point P1 (when the number of printed sheets having the average coverage rate 5% is 240,000 sheets), the image controller 101 stores, in the storage device 120, information including the average coverage rate and the number of printed sheets at the time of the replacement. Then, the image controller 101 derives a new reference line L1.

Figure 9:
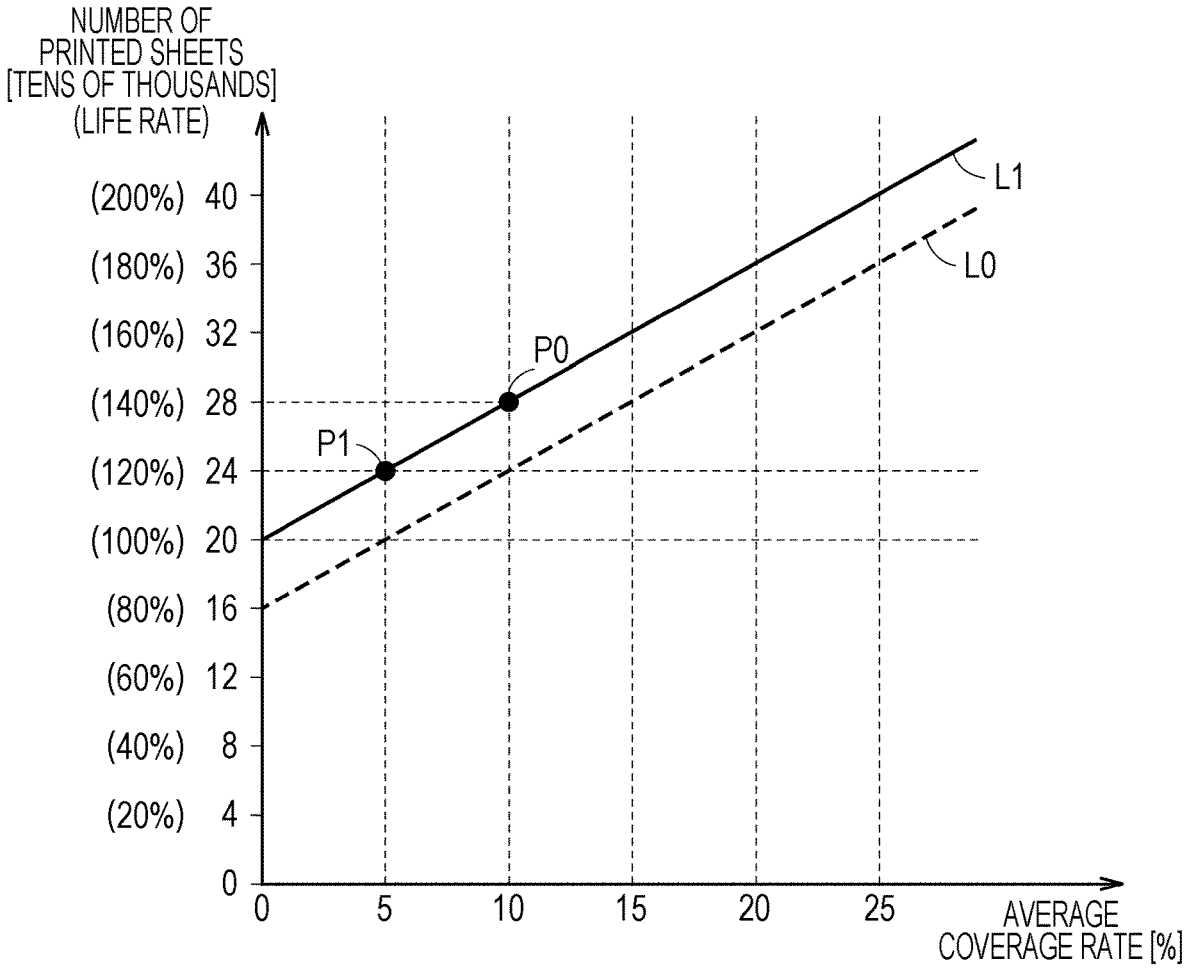
FIG. 9 is a graph illustrating derivation of a reference line according to the present embodiment.

FIG. 9 is a graph illustrating derivation of the reference line L1 according to the present embodiment. As indicated at a point P1 in FIG. 9, the number of printed sheets having the average coverage rate 5% reaches 240,000 sheets. The life rate of the cleaning blade 47 at this point is 120%. In a case where the cleaning blade 47 is replaced at the time of reaching this number of printed sheets, the image controller 101 sets this number of printed sheets as the latest number of printed sheets, and derives the reference line L1 based on: latest replacement history information including the average coverage rate corresponding to this number of printed sheets; and past replacement history information. The past replacement history information is, for example, information of the number of printed sheets of 290,000 sheets (point P0) corresponding to the average coverage rate 10%. These two kinds of replacement history information are stored in the storage device 120 and read by the image controller 101.

The image controller 101 executes a linear regression analysis between an average coverage rate and the number of printed sheets at the point PO and those at point P1 based on the past replacement history information (point P0) and the latest replacement history information (point P1) read from the storage device 120. The image controller 101 derives, from the linear regression analysis, the linear expression (reference line L1) between the average coverage rate and the number of printed sheets. More specifically, the image controller 101 derives the reference line L1 which is an approximate line obtained from the regression analysis in which the number of printed sheets is used as a target variable and the average coverage rate is used as an explanatory variable. The image controller 101 derives the approximate line by using, for example, a least-square method. The image controller 101 stores, as the reference line information 123, the information of the reference line L1 in the storage device 120. Consequently, the image forming apparatus 100 can provide a notification of the replacement timing of the consumable part at the timing suitable for the user based on the newly derived information of the reference line L1. Note that in a case where the consumable part has not been replaced in the past and the consumable part is replaced for the first time, the image controller 101 may derive an approximate line (e.g., reference line L1) by using the latest replacement history information and inclination information of the standard line L0.

Additionally, as the target variable, for example, a rotation distance of the photoreceptor 10 may be also used besides the number of printed sheets. Furthermore, as for the explanatory variable, other parameters may also be used as far as a variable influences a length of a replacement period of the consumable part (length of life). For example, environmental information inside the apparatus, such as a temperature or a humidity inside the image forming apparatus 100, may be used as the explanatory variable. A temperature sensor (not illustrated) and a humidity sensor (not illustrated) are provided in the image forming apparatus 100. Additionally, a rotation time (idle rotation time) in a state in which no toner image is formed on the photoreceptor 10 may also be used as the explanatory variable. Furthermore, a predetermined period (for example, the number of printed sheets for one month (30 days)) may also be used as an explanatory variable. Thus, the image forming apparatus 100 can further improve notification accuracy of the replacement timing by performing the regression analysis in which a parameter that influences the length of the replacement period of the consumable part is used as the explanatory variable. Note that in the case of performing the regression analysis, the image controller 101 performs a simple regression analysis in a case where the number of explanatory variables is one, and performs multiple regression analysis in a case of having a plurality of explanatory variables. Additionally, in a case where the number of printed sheets or the like is defined as the target variable (y) and the average coverage rate or the like is defined as the explanatory variable (x) in derivation of the reference line, a regression expression is as shown in Expression (1), for example.

$$y=ax+b \tag{1}$$

The number of explanatory variables (x) is increased along with increase in the number of parameters. For example, in a case where the number of parameters is two, the number of explanatory variables becomes $a_1x_1+a_2x_2$. Note that "a" represents an inclination and "b" represents an intercept.

As described above, the image controller 101 derives the reference line L1 based on the past replacement history information and the latest replacement history information in accordance with a fact that the number of printed sheets included in the latest replacement history information differs from the number of printed sheets included in the reference line and corresponding to the average coverage rate same as the average coverage rate of the number of printed sheets of the latest replacement history information. Consequently, the image forming apparatus 100 can provide a notification of the replacement timing of the consumable part at timing suitable for a user.

[Second Embodiment]

A second embodiment according to the present disclosure will be described below. An image forming apparatus according to the second embodiment is implemented by using a hardware configuration same as that of an image forming apparatus 100 according to an above-described embodiment. Therefore, the description of the hardware configuration will not be repeated.

In a first embodiment, it is described that an image controller 101 derives, by a linear regression analysis, a linear expression (e.g., reference line L1) between number of printed sheets and an average coverage rate. On the other hand, the image controller 101 may derive a representative value of the number of printed sheets, besides deriving an approximate line like the reference line L1. An exemplary representative value is a median value. In the following, a description will be provided by comparing a case of deriving a reference line and a case of deriving a representative value with reference to FIGS. 10, 11, and 12.

<Example of Deriving Reference Line>

Figure 10:
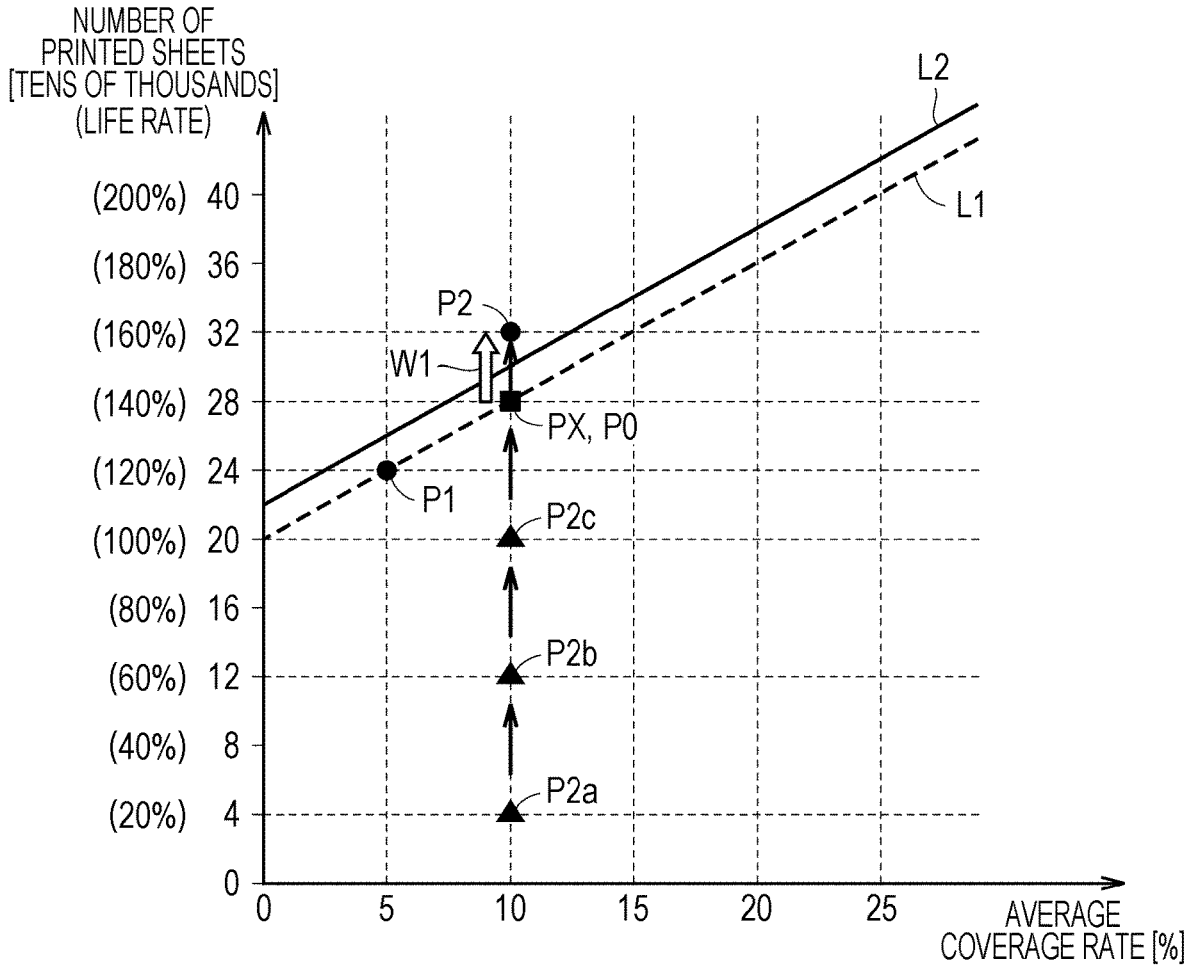
FIG. 10 is a graph illustrating an exemplary case of deriving the reference line according to the present embodiment.

FIG. 10 is a graph illustrating an exemplary case of deriving a reference line according to the present embodiment. In FIG. 10, the number of printed sheets having an average coverage rate 10% is increased to the number of sheets indicated at each of points P2*a*→P2*b*→P2*c* in printing by the image forming apparatus 100. Additionally, FIG. 10 illustrates a fact that a cleaning blade 47 is replaced at the point P2 at which the number of printed sheets corresponding to the average coverage rate exceeds 280,000 sheets (point PX) which is the number of printed sheets serving as a replacement indicator and corresponding to the average coverage rate same as that of the reference line L1 which is a current replacement indicator. The number of printed sheets for replacement timing, which is included in the reference line L1 and corresponds to the average coverage rate 10%, is 280,000 sheets indicated at the point PX. The image controller 101 instructs an operation panel 105 to output replacement information before the number of printed sheets reaches 280,000 sheets (for example, when 279,000 sheets are counted). The operation panel 105 notifies a user of the replacement information based on the instruction from the image controller 101. However, it can be considered that the user does not contact a service person to inform that the replacement information is output because the replacement information that the user is notified is not suitable for replacement timing intended by the user.

Then, in a case where the number of printed sheets at the time of replacing the cleaning blade 47 exceeds the number of printed sheets of the current reference line L1, the image controller 101 determines whether an absolute value of a difference between the number of printed sheets included in latest replacement history information and the number of printed sheets included in the reference line L1 and corresponding to the average coverage rate same as the average coverage rate of the number of printed sheets in the latest replacement history information is less than predetermined first number of sheets. More specifically, the image controller 101 determines whether an absolute value W1 of a difference between the number of printed sheets of 320,000 sheets (point P2) having the average coverage rate 10% and the number of printed sheets of 280,000 sheets (point PX) having the average coverage rate 10% is less than the first number of sheets (e.g., 50,000 sheets). The image controller 101 derives a new reference line L2 based on a fact that the absolute value W1 (40,000 sheets) of the difference between the point PX (280,000 sheets) and the point P2 (320,000 sheets) is less than the first number of sheets (50,000 sheets). More specifically, based on the number of printed sheets corresponding to each of the average coverage rates at the point P2, the point P1, and the point P0 (point PX), the image controller 101 derives the new reference line L2 by executing a linear regression analysis between the average coverage rates and the number of printed sheets of these points.

In the case where the new reference line L2 is derived, the image controller 101 determines arrival of replacement timing of the consumable part based on the new reference line L2 instead of the reference line L1 in the past, and when the replacement timing arrives, the image controller 101 instructs the operation panel 105 to output replacement information. The operation panel 105 notifies a user of the replacement information based on the instruction from the image controller 101. Thus, the image forming apparatus 100 can provide a notification of the replacement timing of the consumable part at timing suitable for the user based on the replacement history information.

<Example in Case of Deriving Representative Value>

Figure 11:
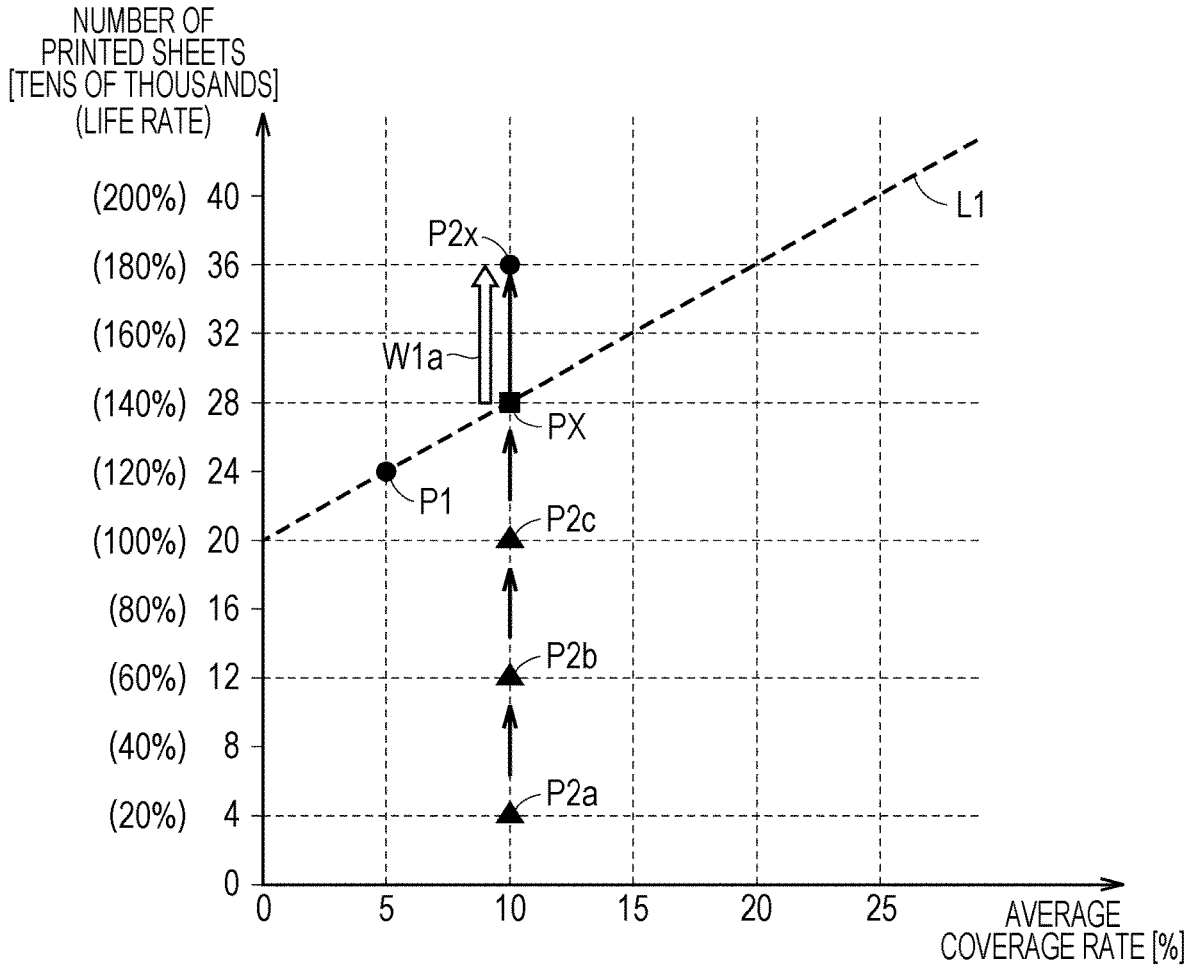
FIG. 11 is a graph illustrating an exemplary case of deriving a representative value according to the present embodiment.

FIG. 11 is a graph illustrating an exemplary case of deriving a representative value according to the present embodiment. In FIG. 11, the number of printed sheets having an average coverage rate 10% is increased to the number of sheets indicated at points P2*a*→P2*b*→P2*c* in printing by the image forming apparatus 100. Additionally, FIG. 11 illustrates a fact that the cleaning blade 47 is replaced at the point P2*x* at which the number of printed sheets corresponding to the average coverage rate exceeds the number of printed sheets of 280,000 sheets (point PX) which is the number of printed sheets serving as a replacement indicator and corresponding to the average coverage rate same as that of the reference line L1 which is a current replacement indicator. The number of printed sheets for replacement timing, which is included in the reference line L1 and corresponds to the average coverage rate 10%, is 280,000 sheets indicated at the point PX. The image controller 101 instructs the operation panel 105 to output the replacement information before the number of printed sheets reaches 280,000 sheets (for example, when 279,000 sheets are counted). The operation panel 105 notifies a user of the replacement information based on the instruction from the image controller 101. However, it can be considered that the user does not contact a service person to inform that the replacement information is output because the replacement information that the user is notified is not suitable for replacement timing intended by the user.

Then, in a case where the number of printed sheets at the time of replacing the cleaning blade 47 exceeds the number of printed sheets of the current reference line L1, the image controller 101 determines whether the absolute value of the difference between the number of printed sheets included in latest replacement history information and the number of printed sheets included in the reference line L1 and corresponding to the average coverage rate same as the average coverage rate of the number of printed sheets in the latest replacement history information is less than the predetermined first number of sheets. In a case where the absolute value is the first number of sheets or more based on the determination result, the image controller 101 determines whether the absolute value is equal to or more than second number of sheets that is larger than the first number of sheets. More specifically, in the case where the absolute value W1*a* (80,000 sheets) of the difference between the point PX (280,000 sheets) and the point P2*x* (360,000 sheets) is the predetermined first number of sheets (e.g., 50,000 sheets) or more, the image controller 101 determines whether the absolute value is the second number of sheets (e.g., 100,000 sheets) or more. The point PX is a point of the replacement indicator. The point P2*x* is a point relating to the latest replacement history information.

Figure 12:
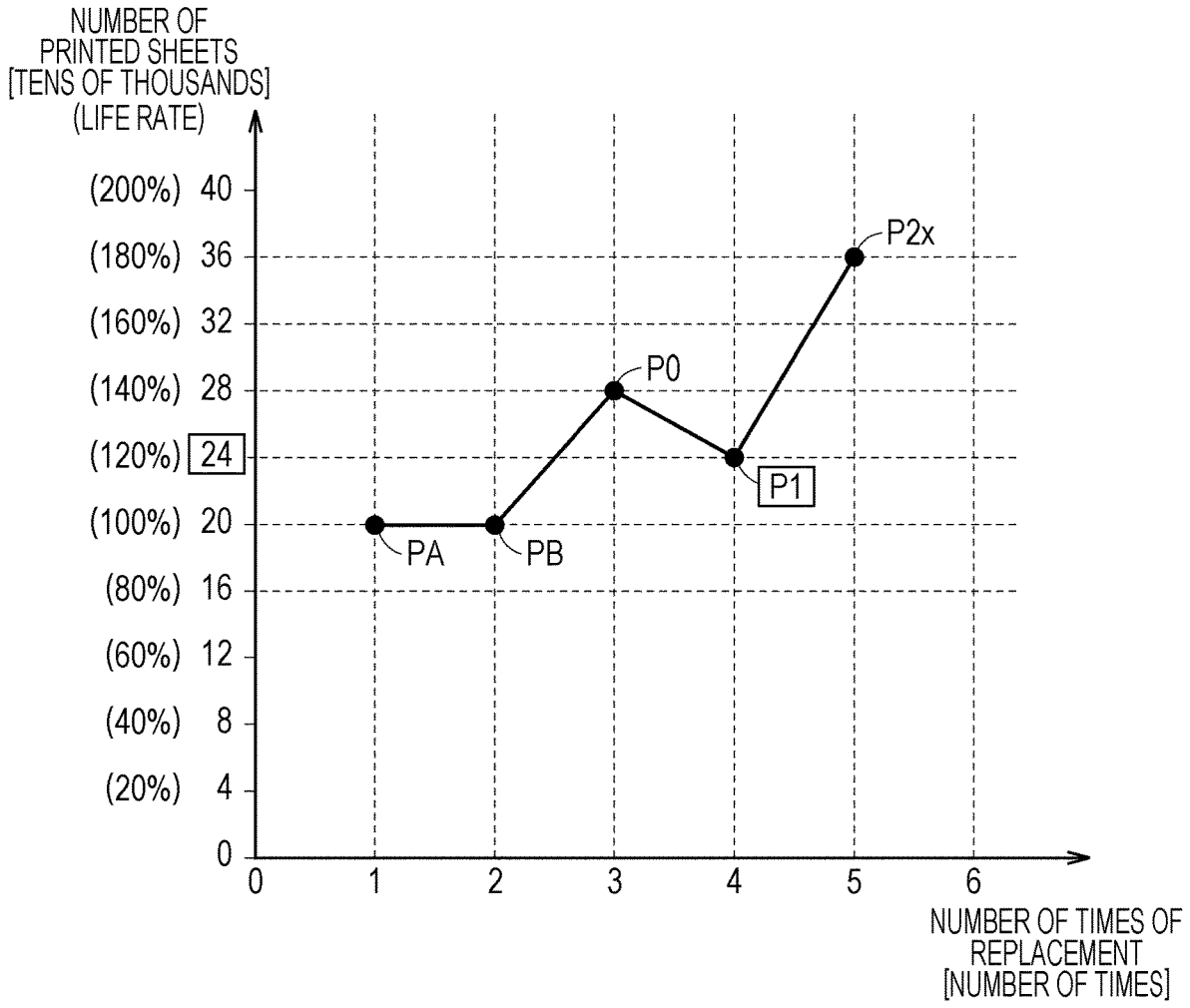
FIG. 12 is a graph illustrating the number of printed sheets at the time of replacing a consumable part according to the present embodiment.

In the case where the number of printed sheets corresponding to the average coverage rate is the first number of sheets or more and also is less than the second number of sheets, the image controller 101 derives a representative value (for example, median value). Derivation of the representative value will be specifically described with reference to FIG. 12. FIG. 12 is a graph illustrating the number of printed sheets at the time of replacing the consumable part according to the present embodiment. FIG. 12 illustrates that the cleaning blade 47 is replaced when the number of printed sheets reaches 360,000 sheets as indicated at the point P2*x* in a case where latest replacement described so far is fifth replacement, for example. Additionally, in past replacement, the number of printed sheets at first replacement is 200,000 sheets indicated at a point PA, the number of printed sheets at second replacement is 200,000 sheets indicated at a point PB, the number of printed sheets at third replacement is 280,000 sheets indicated at a point P0, and the number of printed sheets at fourth replacement is 240,000 sheets indicated at a point P1. The image controller 101 derives a representative value among the number of printed sheets (360,000 sheets) in the latest replacement (fifth replacement) and the number of printed sheets (200,000 sheets, 200,000 sheets, 280,000 sheets, and 240,000 sheets) in the past replacement (first to fourth replacement). More specifically, the image controller 101 derives, as the representative value, the number of printed sheets (point P1) of 240,000 sheets at the fourth replacement, which is a median value between the number of printed sheets in the past replacement and the number of printed sheets in the latest replacement.

The reason why the image controller 101 derives not a reference line (approximate line) but a representative value is that: replacement history information of the consumable part (for example, the number of printed sheets included in the latest replacement history) is the number of sheets different from the number of printed sheets in the past replacement till then by a certain amount or more (the first number of sheets or more and less than the second number of sheets). By thus deriving the representative value, even in a case where a printing state of the image forming apparatus 100 includes a special state during a period from previous replacement to the latest replacement, influence of the special state on the replacement indicator is reduced. The special state is, for example, a state in which the number of sheets larger than the number of printed sheets counted till then are printed while degrading print quality more than in a normal state. For example, as illustrated in FIG. 12, the number of printed sheets in the special state (fifth replacement) is 360,000 sheets whereas the number of printed sheets in the normal state (the number of printed sheets in the first to fourth replacement) is 200,000 to 280,000 sheets. Consequently, even when a use state (print quality or the like) of the image forming apparatus 100 by a user is temporarily changed, the image forming apparatus 100 can notify the user of replacement timing at suitable timing when the user thinks necessary to replace the consumable part.

[Third Embodiment]

A third embodiment according to the present disclosure will be described below. The image forming apparatus according to the third embodiment is implemented by using a hardware configuration same as that of an image forming apparatus 100 according to above-described embodiments. Therefore, the description of the hardware configuration will not be repeated.

<Derivation of Reference Line in Case where Absolute Value is Second Number of Sheets or More>

Figure 13:
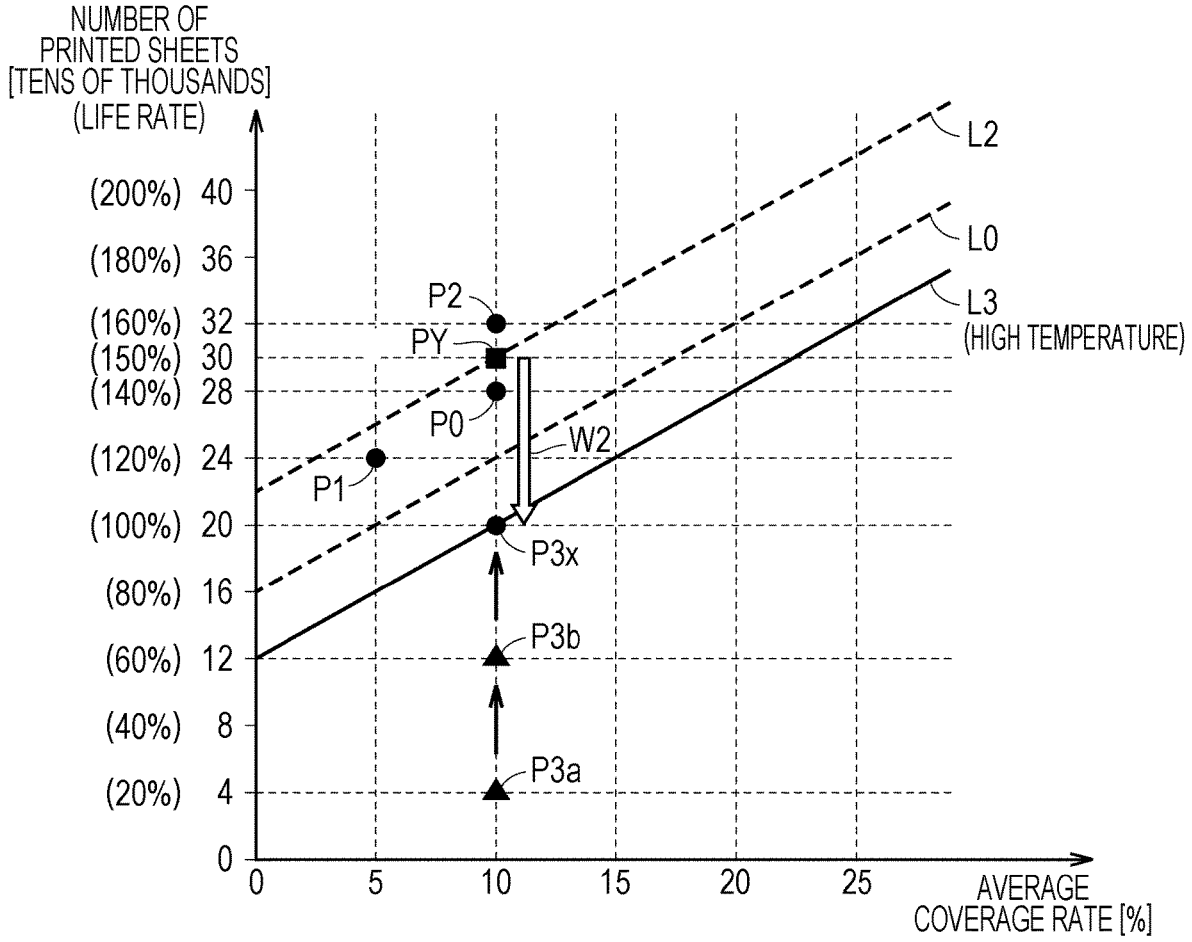
FIG. 13 is a graph to describe derivation of a reference line in a case where an absolute value of a difference between the number of printed sheets is second number of sheets or more according to the present embodiment.

In the second embodiment described above, it is described that an image controller 101 derives a representative value in a case where an absolute value W1*a* of a difference between a point PX and a point P2*x* is predetermined first number of sheets or more and less than second number of sheets. On the other hand, in the third embodiment, a description will be provided with reference to FIG. 13 regarding processing in a case where the absolute value of the difference in the number of printed sheets is the second number of sheets or more. FIG. 13 is a graph to describe derivation of a reference line L3 in the case where the absolute value of the difference in the number of printed sheets is the second number of sheets or more according to the present embodiment.

The image controller 101 derives the reference line L3 in a case where an absolute value of a difference between latest number of printed sheets corresponding to an average coverage rate during a period from latest start of using a consumable part until replacement thereof and reference number of printed sheets included in a reference line L2 and corresponding to the same average coverage rate is the second number of sheets or more. The reference line L3 in FIG. 13 is a reference line derived from a temperature change inside the image forming apparatus 100. More specifically, the reference line L3 is used in a case where the temperature inside the image forming apparatus 100 is high (for example, 50° C. or more) while the reference line L2 is used in a case where the temperature inside the image forming apparatus 100 is a normal temperature (for example, 10° C. or more and less than 50° C.).

The number of printed sheets having an average coverage rate of 10% is increased to the number of sheets indicated at points P3*a*→P3*b* in printing of the image forming apparatus 100. Additionally, in FIG. 13, a cleaning blade 47 is replaced when the number of printed sheets corresponding to the average coverage rate reaches 200,000 sheets (point P3*x*) which is less than 300,000 sheets (point PY) in the reference line L2 that is a current replacement indicator. The number of printed sheets for replacement timing at the average coverage rate 10% in the reference line L2 is 300,000 sheets indicated at the point PY. However, the cleaning blade 47 is replaced when the number of sheets is 200,000 sheets (point P3*x*) before reaching 300,000 sheets. In a case where an absolute value W2 (100,000 sheets) of a difference between the point PY (300,000 sheets) and the point P3*x* (200,000 sheets) is equal to or more than the predetermined second number of sheets (e.g., 100,000 sheets), the image controller 101 derives the reference line L3 by using only latest replacement history information without using past replacement history information as for replacement history information. The reference line L3 has a relatively large difference from the reference line L2 in the number of printed sheets, and a standard line L0 is interposed between the reference line L2 and the reference line L3. In other words, in the same average coverage rate, the absolute value of the difference between the number of printed sheets in the reference lines L2 and the number of printed sheets in the reference line L3 is larger than the absolute value of the difference between the number of printed sheets in the reference line L2 and the number of printed sheets in the standard line L0. Thus, in a case where the temperature inside the image forming apparatus 100 is high, the reference line L3 of the high temperature is provided at a coordinate position striding over the standard line L0 from the reference line L2 of the normal temperature. Therefore, even in the case of the same average coverage rate, the difference in the number of printed sheets is relatively large between the reference line L2 and the reference line L3.

Here, the reason why the absolute value of the difference between the latest number of printed sheets and the reference number of printed sheets is the second number of sheets or more is possibly a case where the temperature inside the image forming apparatus 100 is largely changed while the consumable part is replaced once. Due to such a temperature change, a property of rubber of an edge part of the cleaning blade 47 is changed. More specifically, when the temperature inside the image forming apparatus 100 reaches a predetermined temperature (for example, 50° C.) or more, hardness of the rubber is decreased and an abutment posture of the rubber blade is not stabilized, and abnormal noise or turning-up of the cleaning blade 47 occurs. Therefore, when the temperature inside the image forming apparatus 100 is the high temperature (for example, 50° C. or more) exceeding the normal temperature (for example, 10° C. or more and less than 50° C.), replacement timing of the consumable part becomes earlier than at the time of the normal temperature. In other words, in a case where the average coverage rate is constant, when the temperature is higher than the normal temperature, the number of printed sheets that is the replacement indicator is the smaller number of sheets in the reference line. It can be considered that such a temperature change occurs, for example, in a case where the image forming apparatus 100 is installed in a high-temperature installation place due to a temperature condition change whereas the image forming apparatus 100 has been installed in a normal-temperature installation place till then.

In this case, the image controller 101 cannot notify a user of accurate replacement timing of the consumable part of the image forming apparatus 100 installed in the high-temperature installation place despite a fact that a new reference line is derived based on the past replacement history information obtained when the instillation place of the image forming apparatus 100 had the normal temperature. Therefore, the image controller 101 derives the reference line L3 based on the latest replacement history information and inclination information based on a design specification, without using the past replacement history information. More specifically, the image controller 101 derives the reference line L3 by using information at the point P3*x* that is the latest replacement history information (average coverage rate 10% and the number of printed sheets 200,000 sheets) and inclination information of the standard line L0 without using the replacement history information at the points P0, P1, and P2 which is the past replacement history information. Consequently, even when the temperature inside the image forming apparatus 100 is changed, the image forming apparatus 100 can provide a notification of replacement timing of the consumable part at timing suitable for the user by deriving the reference line L3 based on only the latest replacement history information.

After the reference line L3 is thus derived, in a case where a difference between the number of printed sheets included in the latest replacement history at next replacement and the number of printed sheets included in the reference line L3 and corresponding to the average coverage rate same as that of the number of printed sheets of the latest placement history is less than a first reference value, the image forming apparatus 100 is likely to be continuously installed in the installation place (high-temperature installation place). In this case, similar to derivation of a reference line L1 described in a first embodiment, the image controller 101 executes a linear regression analysis between an average coverage rate and the number of printed sheets. The image controller 101 derives a linear expression (approximate line) between the average coverage rate and the number of printed sheets by the linear regression analysis based on previous replacement history information and the latest replacement history information. Note that since replacement history information prior to the previous time is not used to derive the linear expression because such replacement history information is the information obtained when the image forming apparatus 100 is installed in the installation place where the temperature inside is the normal temperature.

Additionally, in the above-describe content, it is described that the replacement indicator is changed as the property of the rubber at the edge part of the cleaning blade 47 is changed between the case of the normal temperature and the case of the high temperature. On the other hand, besides the temperature, the property of the rubber at the edge part of the cleaning blade 47 is changed between a case of a normal humidity and a case of a high humidity, for example. In the case of the high humidity (for example, humidity exceeding 120%), abnormal noise of the cleaning blade 47 or turning-up of the blade is likely to occur because hardness of the rubber is decreased similar to the case of the high temperature. Therefore, similar to the above-described case of the high temperature, in the case of the high humidity also, the image controller 101 may derive the reference line L3 based on only the latest replacement history information when the absolute value of the difference between the latest number of printed sheets and the standard number of printed sheets at the same average coverage rate is the second number of sheets or more.

<Control Structure of Image Controller 101>

Figure 14:
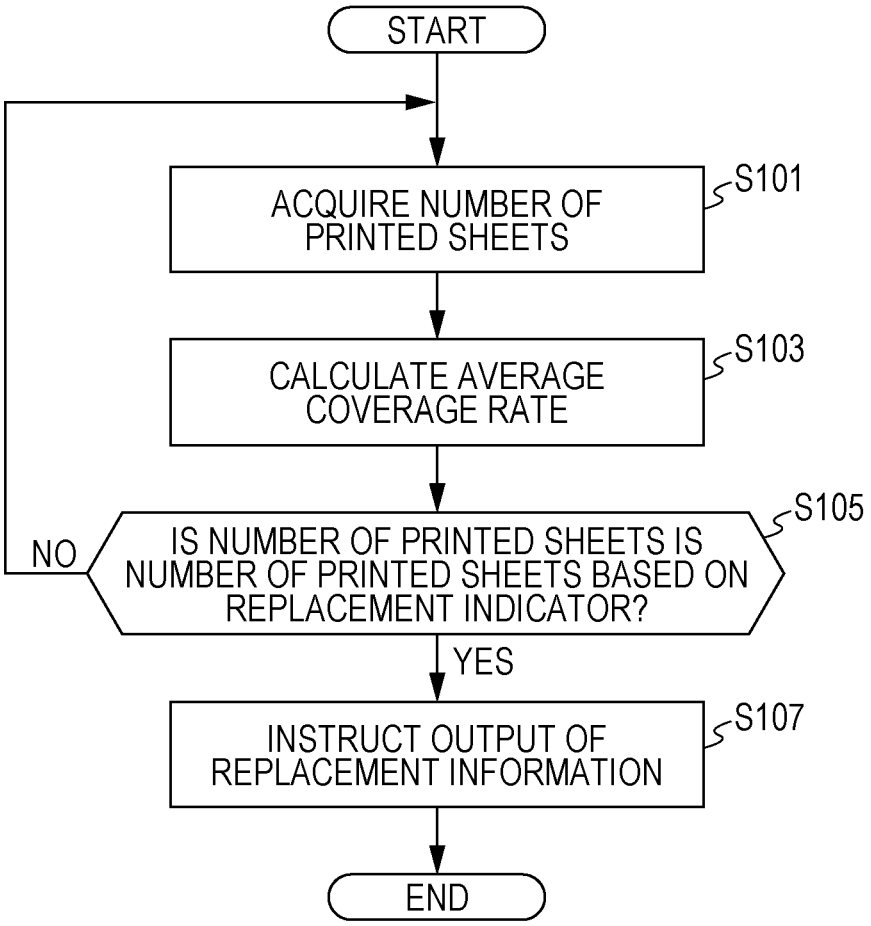
FIG. 14 is a flowchart of replacement information output processing executed by an image controller according to the present embodiment.

The content of the first to third embodiments of the present invention can be combined as appropriate. A control structure of the image controller 101 according to the first to third embodiments will be described below. The control structure of the image controller 101 will be described with reference to FIGS. 14 and 15. FIG. 14 is a flowchart of replacement information output processing executed by the image controller 101 according to the present embodiment. The processing illustrated in FIG. 14 is implemented by the image controller 101 reading the control program 122 of the storage device 120 and executing the processing included in the control program 122. In another aspect, some or all of the processing may be executed by a circuit element or another hardware.

In step S101, the image controller 101 acquires information of the number of printed sheets from the counter 130, and switches the control to step S103.

In step S103, the image controller 101 calculates a coverage rate per printed page, calculates an average coverage rate for the number of printed sheets, and switches the control to step S105.

In the processing in step S105, the image controller 101 determines, based on a replacement indicator, whether current number of printed sheets corresponding to the average coverage rate is the number of sheets at which a notification of consumable part replacement is to be provided. In a case where the current number of printed sheets corresponding to the average coverage rate is the number of sheets at which the notification of consumable part replacement is to be provided (YES in step S105), the image controller 101 switches the control to step S107. In the case of No (NO in step S105), the image controller 101 executes the processing in step S101 again. Note that the number of sheets at which the notification of consumable part replacement based on the replacement indicator is to be provided is when, for example, the current number of printed sheets in accordance with a certain average coverage rate is the number of sheets that is fewer by a predetermined value (such as 1,000 sheets) than the number of printed sheets included in the reference line and corresponding to the same average coverage rate.

In the processing of step S107, the image controller 101 instructs the operation panel 105 to output replacement information of the consumable part. Consequently, the image forming apparatus 100 can notify a user of replacement timing of the consumable part.

Figure 15:
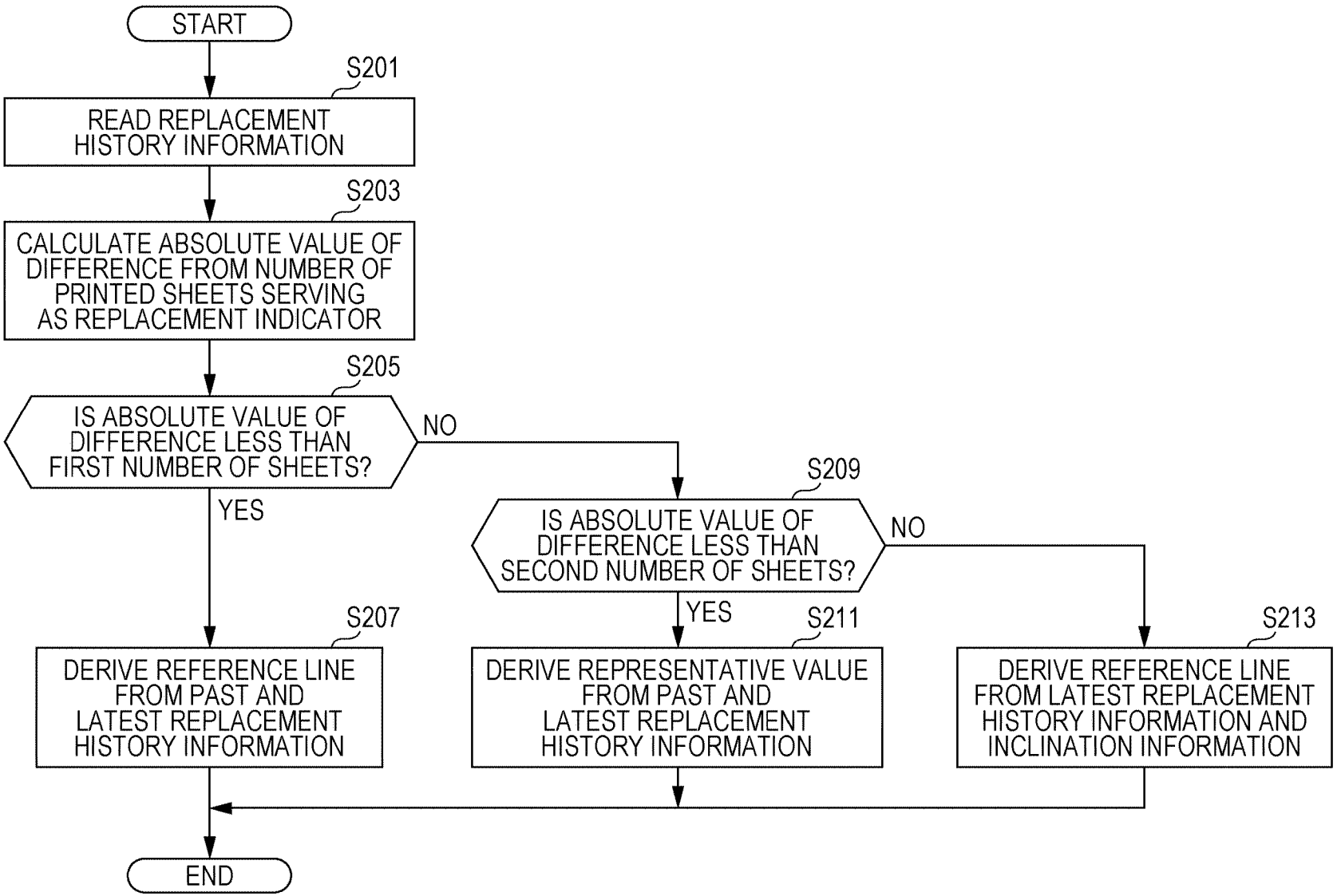
FIG. 15 is a flowchart of derivation processing of a replacement indicator including a reference line and a representative value, in which the derivation processing is executed by the image controller according to the present embodiment.

Next, FIG. 15 is a flowchart of derivation processing of a replacement indicator including a reference line and a representative value, in which the derivation processing is executed by the image controller 101 according to the present embodiment. In step S201, the image controller 101 reads latest replacement history information (average coverage rate and the number of printed sheets) from the storage device 120, and switches the control to step S203.

In step S203, the image controller 101 calculates an absolute value of a difference between the number of printed sheets included in the latest replacement history and the number of printed sheets included in the reference line (e.g., reference line L1) corresponding to the average coverage rate same as the average coverage rate of the number of printed sheets of the latest replacement history, and switches the control to step S205.

In step S205, the image controller 101 determines whether the absolute value of the difference is less than the first number of sheets (e.g., 50,000 sheets). In a case where the absolute value of the difference is less than the first number of sheets (YES in step S205), the image controller 101 switches the control to step S207. In the case of No (NO in step S205), the image controller 101 switches the control to step S209.

In step S207, the image controller 101 derives a reference line (e.g., reference line L1) based on past replacement history information and the latest replacement history information. Thus, since a notification of replacement timing of the consumable part is provided based on user's replacement history information so far, the image forming apparatus 100 can provide a notification at timing suitable for a user.

In step S209, the image controller 101 determines whether the absolute value of the difference is less than second number of sheets (e.g., 100,000 sheets). In a case where the absolute value of the difference is less than the second number of sheets (YES in step S209), the image controller 101 switches the control to step S211. In the case of No (NO in step S209), the image controller 101 switches the control to step S213.

In step S211, the image controller 101 derives a representative value (e.g., median value) based on a plurality of pieces of replacement history information. Consequently, even when a use state of the image forming apparatus 100 by the user is temporarily changed, the image forming apparatus 100 can provide a notification of the replacement timing of the consumable part at timing suitable for the user based on the replacement history in a normal use state of the user. The temporary change in the use state is, for example, temporarily printing a large number of sheets while degrading the average coverage rate, or the like.

In step S213, the image controller 101 derives a reference line L3 based on the latest replacement history information and inclination information of a standard line (e.g., standard line L0) which is the replacement indicator of the design specification. Consequently, even when an environmental state such as a temperature inside the image forming apparatus 100 is changed, the image forming apparatus 100 can provide a notification of the replacement timing of the consumable part at the timing suitable for the user.

<Modified Example>

In the present embodiments, it is described that the image controller 101 derives the replacement indicators including the reference line and the representative value from the number of printed sheets from start of using the consumable part until replacement thereof. On the other hand, the image controller 101 may derive the replacement indicator based on a rotation distance (cumulative rotation distance) of the photoreceptor 10 from start of using the consumable part until replacement thereof. Here, the rotation distance is a cumulative amount obtained by multiplying a peripheral speed of a roller of the photoreceptor 10 by time. In a case where the image forming apparatus 100 derives the replacement indicator from the rotation distance, for example, it is possible to use a standard line in which a distance corresponding the life rate 100% is set to, for example, 10,000 km. The image controller 101 may derive a linear expression between an average coverage rate and the rotation distance by a linear regression analysis based on past replacement history information and latest replacement history information. Also, the image controller 101 may derive the linear expression by using an explanatory variable other than the average coverage rate.

Furthermore, in the present embodiments, the cleaning blade 47 is described as the example of the consumable part, but a consumable part other than the cleaning blade 47 in the image forming apparatus 100 is also applicable to the present embodiments. As described in the present embodiments, the image forming apparatus 100 includes various kinds of consumable parts such as the photoreceptor 10, the primary transfer roller 31, and the secondary transfer roller 33. For example, the more number of times the secondary transfer roller 33 is used, the more a resistance value of the roller is increased. When the resistance value is increased, transfer current flowing in the secondary transfer roller 33 is decreased in a case where transfer voltage applied to the secondary transfer roller 33 is constant. With such decrease in the transfer current, a toner image on the transfer belt 30 may not be transferred to paper and remain on the belt. Such a phenomenon is more likely to occur in an image having a higher average coverage rate. Therefore, as for a notification of replacement timing of the secondary transfer roller 33 also, the image controller 101 derives a replacement indicator by using the average coverage rate information of the number of printed sheets, and can provide a notification of the replacement timing of the secondary transfer roller 33 suitable for replacement timing of the user.

Additionally, in the present embodiments, the image controller 101 instructs the operation panel 105 to output the replacement information before reaching the number of printed sheets that is the replacement indicator, and notifies the user of the replacement information. For example, in a case where an average coverage rate is 5% in the reference line L1, "before reaching the number of printed sheets of the replacement indicator" means before reaching the number of printed sheets of 240,000 (for example, when 239,000 sheets are counted), and in a case where the average coverage rate is 15%, "before reaching the number or printed sheets" means before reaching the number of printed sheets of 320,000 sheets (for example, when 319,000 sheets are counted). Thus, it is described that the user is notified of the replacement information when the number of printed sheets reaches the certain number of sheets before the number of printed sheets of the replacement indicator (for example, 1,000 before) regardless a value of the average coverage rate. On the other hand, the larger the average coverage rate is, the smaller the difference between the number of printed sheets of the replacement indicator and the number of printed sheets of the notification timing of the replacement information may be set. More specifically, in the case where the average coverage rate is 5%, for example, the image controller 101 sets the number of printed sheets of the notification timing at 239,000 sheets (1,000 sheets before), and in the case where the average coverage rate is 15%, the image controller 101 sets the number of printed sheets of the notification timing at 319,500 sheets (500 sheets before). The larger the average coverage rate is, the lower a wear rate of an edge part of the consumable part (e.g., cleaning blade 47) is. Therefore, by delaying notification timing more than in the case where the average coverage rate is small, the image forming apparatus 100 can be used for as long a period as possible while securing performance of the consumable part.

Additionally, in the present embodiments, the example in which the approximation line is an approximation line obtained by a linear expression is described, but the approximate line may be an approximate line of any one of a quadratic expression or a cubic expression other than the linear expression, or may be an approximate line other than these approximate lines.

Furthermore, in the present embodiments, it is described that the representative value is the median value, but the representative value may be a mode value. Also, the representative value may be either an arithmetic mean value or a moving average value.

Although embodiments of the present invention have been described and illustrated in detail, the disclosed embodiments are made for purposes of illustration and example only and not limitation The scope of the present invention should be interpreted by terms of the appended claims, and it is intended to include meanings equivalent to the scope of claims and all of changes within the scope of the claims.

What is claimed is:

1. An image forming apparatus comprising:

a counter that counts number of sheets of paper on which printing is performed;

a calculator that calculates a coverage rate of each sheet of the paper;

a derivation part that derives a reference line to be a replacement indicator for a consumable part based on replacement history information including: number of printed sheets from start of using the consumable part provided in the image forming apparatus until replacement of the consumable part; and an average coverage rate obtained by averaging coverage rates on the sheets of the paper corresponding to the number of printed sheets; and a communicator that provides a notification of arrival of replacement timing of the consumable part based on the reference line, wherein the derivation part derives a first reference line different from the reference line based on past replacement history information and latest replacement history information in accordance with a fact that number of printed sheets included in the latest replacement history information differs from number of printed sheets included in the reference line and corresponding to an average coverage rate same as an average coverage rate of the number of printed sheets of the latest replacement history information, and the communicator provides a notification of arrival of replacement timing of the consumable part based on the first reference line in a case where the first reference line is derived.

2. The image forming apparatus according to claim 1, wherein, in a case where the different number of printed sheets is less than first number of sheets, the derivation part drives the first reference line, and in a case where the different number of printed sheets is the first number of sheets or more and also less than second number of sheets that is larger than the first number of sheets, the derivation part derives a representative value of the number of printed sheets based on the past replacement history information and the latest replacement history information, and in a case where the representative value is derived, the communicator provides a notification of arrival of replacement timing of the consumable part based on the representative value.

3. The image forming apparatus according to claim 2, wherein in a case where the different number of printed sheets is the second number of sheets or more, the derivation part derives a second reference line different from the first reference line based on the latest replacement history information and inclination information of a standard line serving as a replacement indicator of a design specification.

4. The image forming apparatus according to claim 3, wherein each of the first reference line and the second reference line includes an approximate line derived by a regression analysis in which the number of printed sheets is set as a target variable and the average coverage rate is set as an explanatory variable.

5. The image forming apparatus according to claim 4, wherein the explanatory variable includes at least one of a temperature inside the image forming apparatus, a humidity inside the image forming apparatus, and an idle rotation time of an image carrier provided in the image forming apparatus.

6. The image forming apparatus according to claim 1, wherein the consumable part includes a cleaning blade.

7. A managing method for an image forming apparatus, comprising:

counting number of sheets of paper on which printing is performed;

calculating a coverage rate of each sheet of the paper;

deriving a reference line to be a replacement indicator for a consumable part based on replacement history information including: number of printed sheets from start of using the consumable part provided in the image forming apparatus until replacement of the consumable part; and an average coverage rate obtained by averaging coverage rates on the sheets of the paper corresponding to the number of printed sheets; and providing a notification of arrival of replacement timing of the consumable part based on the reference line, wherein the deriving includes deriving a first reference line different from the reference line based on past replacement history information and latest replacement history information in accordance with a fact that number of printed sheets included in the latest replacement history information differs from number of printed sheets included in the reference line and corresponding to an average coverage rate same as an average coverage rate of the number of printed sheets of the latest replacement history information, and the communicating includes providing a notification of arrival of replacement timing of the consumable part based on the first reference line in a case where the first reference line is derived.

* * * * *